US010137502B1

(12) United States Patent
Nagarathnam et al.

(10) Patent No.: US 10,137,502 B1
(45) **Date of Patent: *Nov. 27, 2018**

(54) NEAR NET SHAPE COMBUSTION DRIVEN COMPACTION PROCESS AND REFRACTORY COMPOSITE MATERIAL FOR HIGH TEMPERATURE APPLICATIONS

(75) Inventors: Karthik Nagarathnam, Culpepper, VA (US); Donald Trostle, Herndon, VA (US); David L. Kruczynski, Amissville, VA (US); Dennis W. Massey, Markham, VA (US)

(73) Assignee: Utron Kinetics, LLC, Manassas, VA (US)

( * ) Notice: Subject to any disclaimer, the term of this patent is extended or adjusted under 35 U.S.C. 154(b) by 1753 days.

This patent is subject to a terminal disclaimer.

(21) Appl. No.: 11/975,910

(22) Filed: Oct. 22, 2007

Related U.S. Application Data

(60) Provisional application No. 60/853,360, filed on Oct. 20, 2006.

(51) Int. Cl.
*B22F 3/23* (2006.01)
*B22F 1/02* (2006.01)

(52) U.S. Cl.
CPC ..... *B22F 3/23* (2013.01)

(58) Field of Classification Search
CPC . B22F 2999/00; C22C 27/00; C22C 32/0031; C22C 14/00; C22C 16/00
USPC ..... 148/300–301; 420/429–430
See application file for complete search history.

(56) References Cited

U.S. PATENT DOCUMENTS

| | | | | |
|---|---|---|---|---|
| 3,318,683 | A * | 5/1967 | Foster, Jr. et al. | 75/345 |
| 3,399,981 | A * | 9/1968 | Bergeron et al. | 428/570 |
| 3,577,227 | A * | 5/1971 | Davies | 428/566 |
| 4,166,375 | A | 9/1979 | Stepantsov et al. | |
| 4,479,466 | A * | 10/1984 | Greenway et al. | 123/527 |
| 4,599,060 | A | 7/1986 | Flinn et al. | |
| 4,658,629 | A | 4/1987 | Milisavljevic | |
| 4,863,881 | A | 9/1989 | Ahrens et al. | |

(Continued)

OTHER PUBLICATIONS

Moore et al., Production and Properties of Mo-41% Re, Space Technology and Applications International Forum, 2002.*

(Continued)

*Primary Examiner* — Xiaowei Su
(74) *Attorney, Agent, or Firm* — James Creighton Wray; Meera P. Narasimhan

(57) ABSTRACT

Near net shape refractory material is made in combustion driven compaction. The gas mixture is combusted, driving a piston or ram into a die containing refractory material powder, compressing the powder into a near net shape. As the chamber is filled with gas, the piston or ram is allowed to rest on the powder, pre-compressing the powder and removing trapped air. During compression, forces reach 150 tsi or more. Loading occurs within several hundred milliseconds. After compression, the shaped refractory part is sintered in a hydrogen environment. This process creates near net shape components with little scrap metal. The apparatus used to perform this process is about the size of a telephone booth and can be moved with a standard forklift. The powder may include a combination of Mo—Re, Re, W—Re, HfC and Hf of a fineness dictated by desired shrinkage, resulting in a material suitable for high-stress, high-temperature applications.

25 Claims, 23 Drawing Sheets

(56) References Cited

U.S. PATENT DOCUMENTS

| | | | | |
|---|---|---|---|---|
| 5,087,435 | A | 2/1992 | Potter et al. | |
| 5,405,574 | A | 4/1995 | Chelluri et al. | |
| 5,611,139 | A | 3/1997 | Chelluri et al. | |
| 5,722,034 | A * | 2/1998 | Kambara | 419/26 |
| 5,935,461 | A | 8/1999 | Witherspoon et al. | |
| 5,989,487 | A | 11/1999 | Yoo et al. | |
| 5,996,385 | A | 12/1999 | Kecskes | |
| 6,001,304 | A | 12/1999 | Yoo et al. | |
| 6,004,120 | A | 12/1999 | Matsubara et al. | |
| 6,183,690 | B1 | 2/2001 | Yoo et al. | |
| 6,187,087 | B1 | 2/2001 | Yoo et al. | |
| 6,325,965 | B1 | 12/2001 | Makita et al. | |
| 6,551,377 | B1 * | 4/2003 | Leonhardt | B22F 1/0014 75/255 |
| 6,767,505 | B2 * | 7/2004 | Witherspoon et al. | 419/45 |
| 6,773,663 | B2 * | 8/2004 | Adams | 420/433 |
| 6,911,063 | B2 * | 6/2005 | Liu | 75/236 |
| 7,744,812 | B2 * | 6/2010 | Witherspoon et al. | 419/66 |
| 8,999,230 | B1 * | 4/2015 | Nagarathnam | B22F 3/23 419/38 |
| 2004/0265161 | A1 * | 12/2004 | Witherspoon | B22F 3/087 419/52 |
| 2005/0238522 | A1 * | 10/2005 | Leonhardt et al. | 419/28 |
| 2008/0003452 | A1 * | 1/2008 | Brockmeyer et al. | 428/655 |

OTHER PUBLICATIONS

Turk et al., Alloy Ionizer Fabrication, NASA, May 1966.*
ASM Handbook, vol. 7: Metal Technologies and Applications, ASM International, 1998.*
Nagarathnam, Ceramic Defense: Processing with controlled combustion, Jun. 1, 2006.*
Nagarathnam-2, Materials behavior and manufacturing aspects of high pressure combustion driven compaction P/M components, 2004 International Conference on Powder Metallurgy & Particulate Materials, Jun. 13-17, 2004.*
Tsao (Journal of Thermophysics and Heat Transfer, 1992, vol. 6, p. 680-684).*
Mitchell et al. (Advances of composite molybdenum-rhenium powders, Advanced Materials & Processes, Dec. 2003, p. 38-39).*
Rusnak, R.M.; *Energy Relationships in the High Velocity Compaction of Copper Powder*; Int. Journal of Powder Metellurgy and Powder technology; vol. 12, No. 2; (Apr. 1976); pp. 91-99.
Lennon et al.; *Explosive Compaction of Metal Powders*; Powder Metallurgy; No. 1; (1978); pp. 29-34
Lenel, F.V.; *Powder Metallurgy: Principles and Applications*; Chapter 4, Compacting; Metal Powder Industries Federation, (1980); pp. 99-157
Raybould, D.; *Dynamic Powder Compaction*; The Carbide and Tool Journal;(Mar.-Apr. 1984); pp. 7-11
German, R.M.; *Powder Metallurgy Science*; Chapter 5, Compaction; Metal Powder Industries Federation, (1984); pp. 113-233
Gourdin, W.H.; *Dynamic Consolidation of Metal Powders*; Progress in Materials Science, vol. 30 No. 4; pp. 39-80, 1986
DeLuca, R.J.; *Description of Railgun Deposition Process*; Appendix B to Final Technical Report UTCMSE-87-02; Univ. of Texas at Austin (Feb. 1987)
Baird et al.; *Density-energy Relationships in Explosive Compaction of Metal Powders*; Powder Metallurgy, vol. 30, No. 4 (1987); pp. 281-285
Yadav et al; *Study of Explosive and Shock Parameters for compaction of Powders*; propellants, Explosives, and Pyrotechnics; vol. 15 (1990); pp. 194-200.
Prummer, R.; *Explosive Compaction in Materials Science*; Metall., 51, Jahrgang, No. 5/97; pp. 333-335.
Hagemeyer et al.; *Dynamic Compaction of Metal Powders with a High Velocity Impact Device*; Int. Journal of Powder Metallurgy, vol. 4, No. 3 (1968); pp. 19-25
Rosato et al.; *Manufacture of Powder Compacts*; International Materials Review; vol. 36, No. 2 (1991) pp. 45-61
Tidman et al.; *Electrothermal Light Gas Gun*; IEEE Transactions on Magnetics, vol. 29, No. 1; Jan. 1993; pp. 621-624
Dowding et al.; *Synthesis and consolidation of Nanoparticles*; in Advances in Powder Metallurgy and Particulate Materials—1994 vol. 5 (Specialty Materials and Composites); pp. 45-58

* cited by examiner

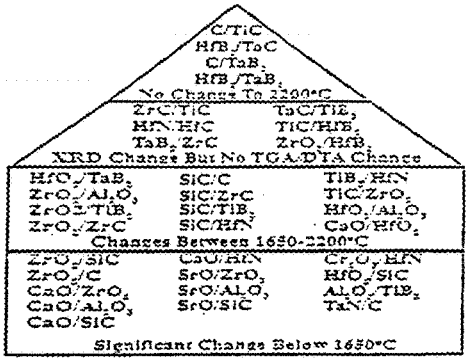
Fig. 1a. Ceramic Materials for High Temperature Applications
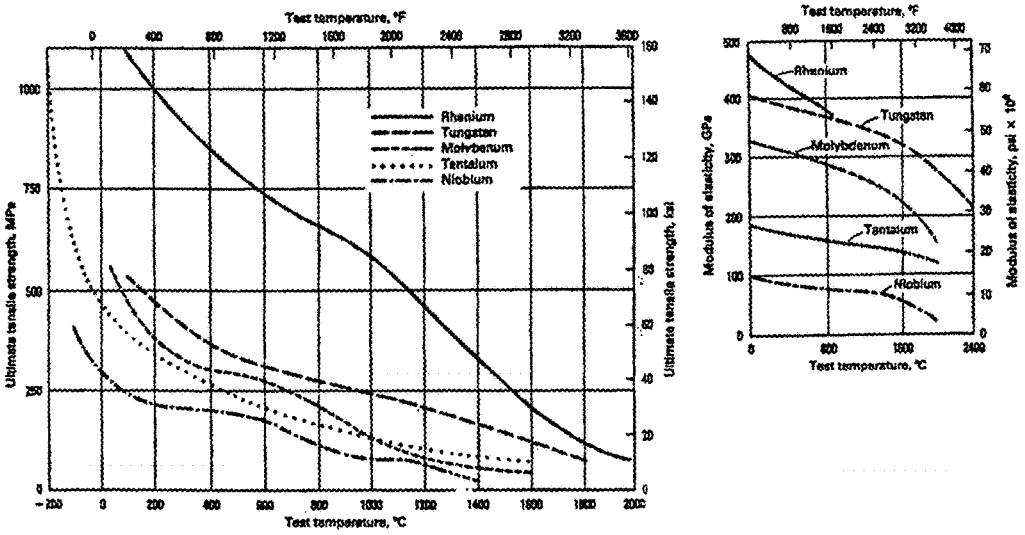
Fig. 1b Mechanical Properties of Refractory Materials as a Function of Temperatures

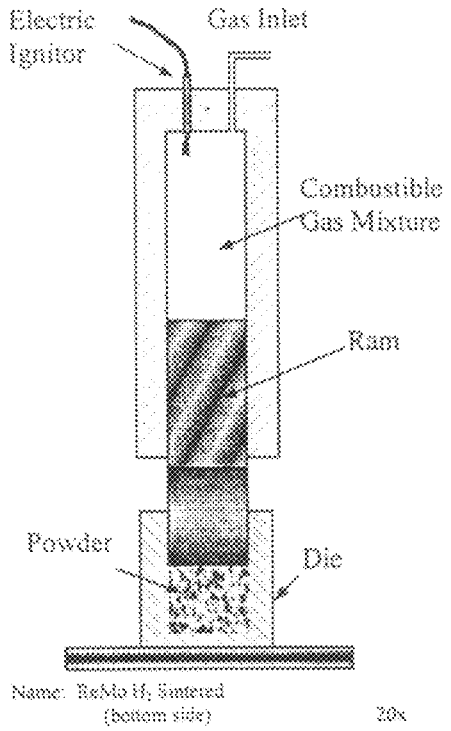
Fig. 2
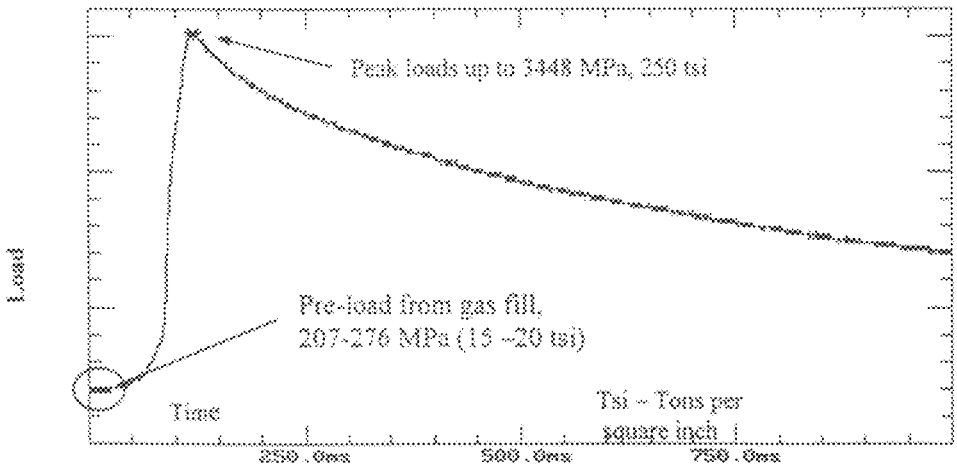
Fig. 3 - Typical CDC Compaction Load

Compactness of UTRON's CDC Press with Traditional Press

Scaled Up Version of Newly Assembled 1000 Ton CDC Press

ADDITIONAL PROPERTIES OF CDC PROCESSED MATERIALS

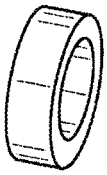

| MATERIAL | LOAD (tsi) | DENSITY (g/cc) | ROUGHNESS (microns) | HARDNESS ($kg/mm^2$) |
|---|---|---|---|---|
| Al-Mg ALLOYS | 52 | 2.632 | 0.2-0.6 | 39 - 47 (GREEN & SINTERED) |
| LOW CARBON STEEL | 154 | 7.59 | 0.1936 | 85 - 100 (SINTERED) |
| AUSTENITIC STAINLESS | 150 | 7.537 | 0.1698 | 200 (GREEN) |
| COPPER | 150 | 8.718 | 0.1695 | 100 (GREEN) |

| PROCESS | % SCRAP |
|---|---|
| MACHINING | 10-60 |
| FORGING | 20-25 |
| FORMING | 10-25 |
| EXTRUSION | 15 |
| CASTING | 10 |
| **POWDER** | **5** |

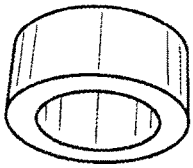

COMBUSTION DRIVEN COMPACTION

% SCRAP VS MANUFACTURING PROCESS, CDC COPPER & STAINLESS STEEL RINGS AND SELECT MATERIAL PROPERTIES

*FIG. 5*

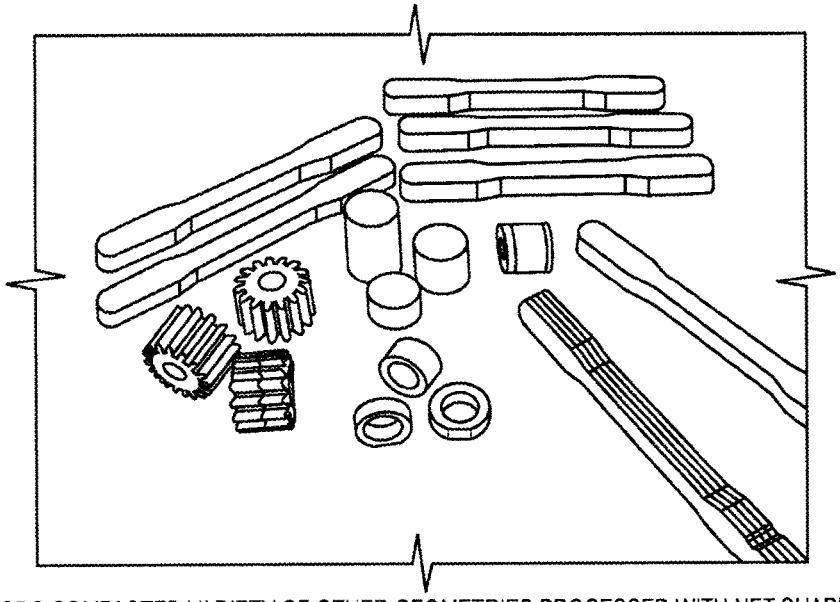

CDC COMPACTED VARIETY OF OTHER GEOMETRIES PROCESSED WITH NET SHAPE FINISH/SURFACE QUALITY ATTRIBUTES

*FIG. 6*

UTRON'S CDC PROCESSED, OPTIMIZED AND SUCCESSFULLY TESTED AT 3500degF OF Mo/Re ALLOYS (Hf, HfC) AFTER MECHANICAL TESTING INDICATING DUCTILE FRACTURES (WITH ADEQUATE DUCTILITY AND STRENGTH LEVELS)

HIGH TEMPERATURE MECHANICAL PROPERTIES OF CDC Mo/Re ALLOYS

Sintered tensile dogbone Samples before and after mechanical testing at room temperature (Hydrogen sintering @ 2100 degC; 14 hrs)

Hydrogen Sintered CDC Disk and Tensile Dogbone Samples (2100 deg C; 14 hrs) [44]

GREEN RING GEOMETRIES SUCCESSFULLY FABRICATED AT 150 tsi ON A VARIETY OF Re/Mo ALLOYS WITH Hf AND HfC
(ALLOY COMPOSITIONS AND PROPERTIES ARE LISTED IN TABLE 13)

SAMPLE # 1023, 1024, 1025, 1026, 1027, 1028, 1029, 1030
SINTERED RING SAMPLES. (2300 degC; 4 HRS IN HYDROGEN) [44]

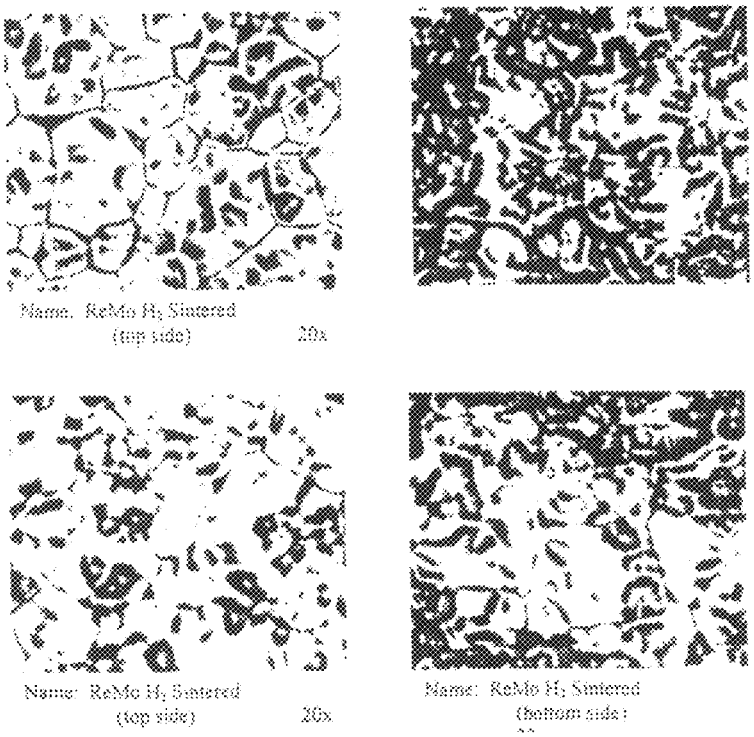
Fig. 10. Microstructures of Hydrogen Sintered CDC ReMo Samples

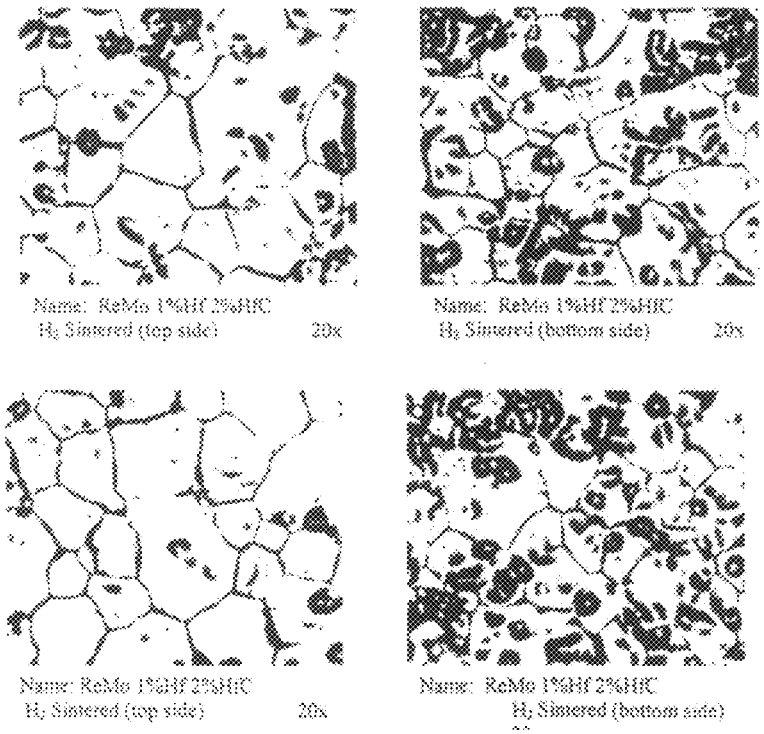
Fig. 11. Microstructures of Hydrogen Sintered CDC ReMo-Hf-HfC Composite Samples Sintered 52.5 Mo-47.5 Re Disk (#877)
H2 Sinter-2100; 14hrs Sintered 52.5 Mo-47.5 Re -1 Hf
(Sample#907) H2 Sinter-2100; 14hrs Sintered CDC Mo-Re-12.5 HfC
(Sample#897) H2 Sinter-2100; 14hrs

Fig. 15 Sample#907-XRay EDS of Matrix and Hf-Rich Areas of Sintered CDC Mo-Re-1Hf microstructure

(Hydrogen; 2100 deg C; 14 hrs)

Sample#907-XRay EDS Dot Map of Re,Hf,Mo and O in Sintered CDC Mo-Re-1Hf microstruciure FIG. 17
X-ray EDS Dot Maps of Mo, Hf, Re and O in Mo/Re/12.5 HfC Microstructures
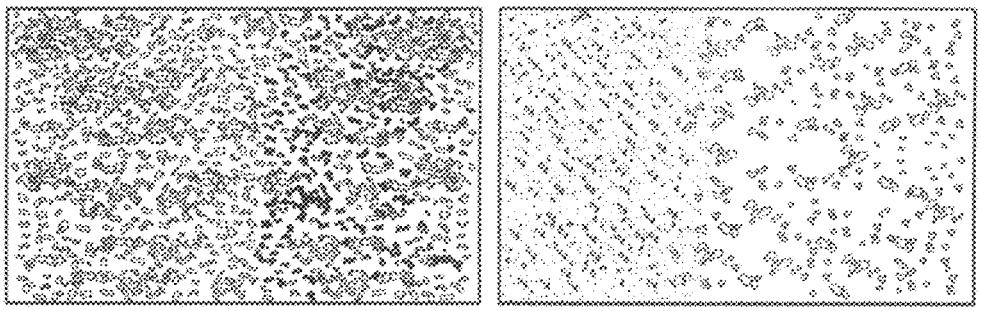
Mo La1 Hf La1
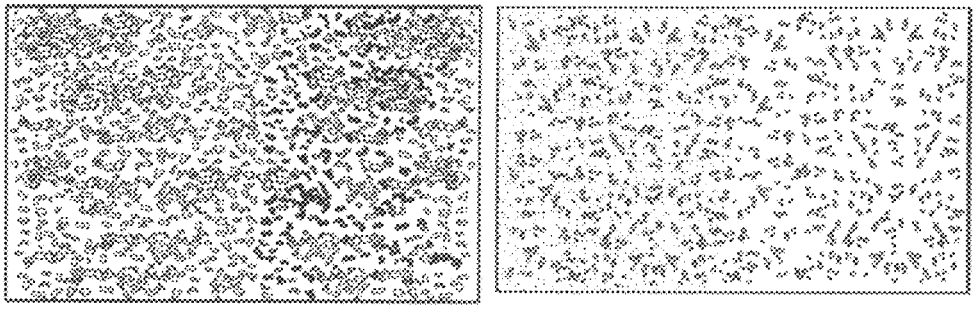
Re Ma O Ka1

CDC Near-Net Shape Rocket Nozzle System
Parts (Using Coarse & Fine Powders)

Figure 19a. High Temperature Mechanical Test Results
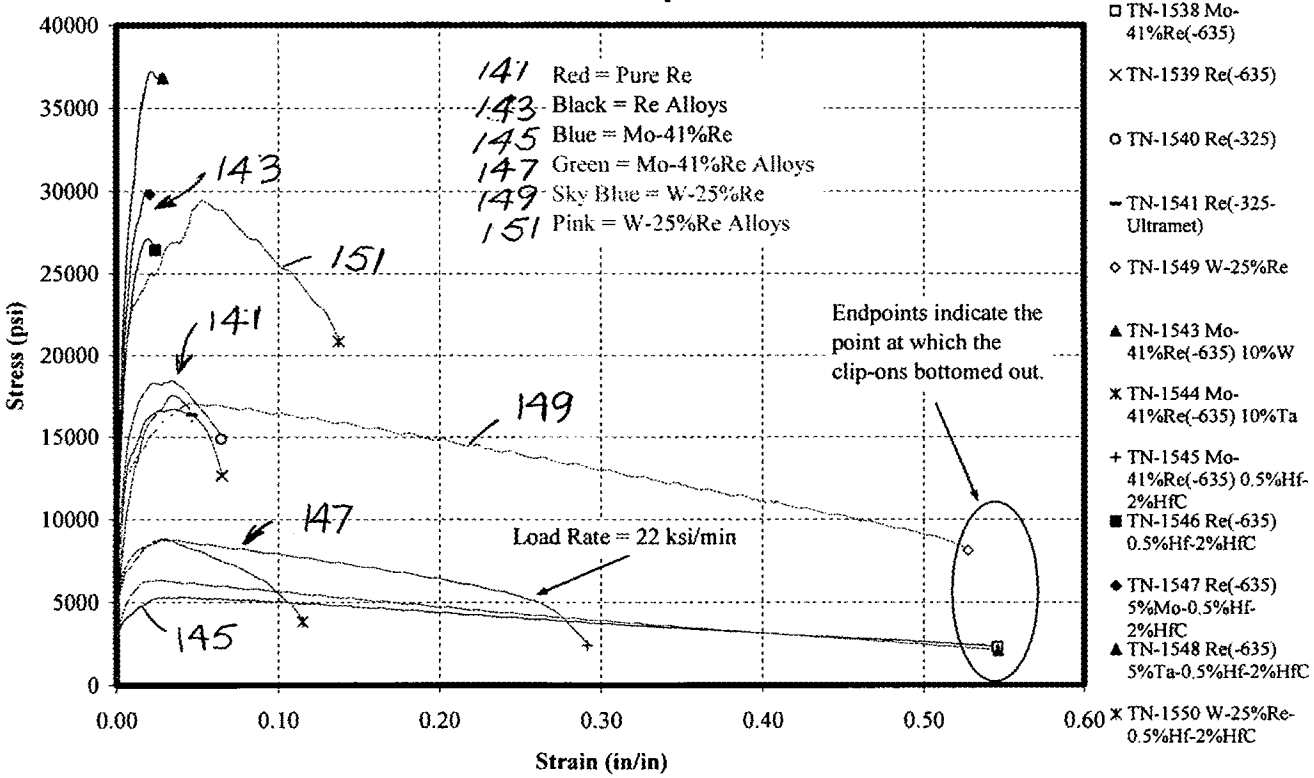

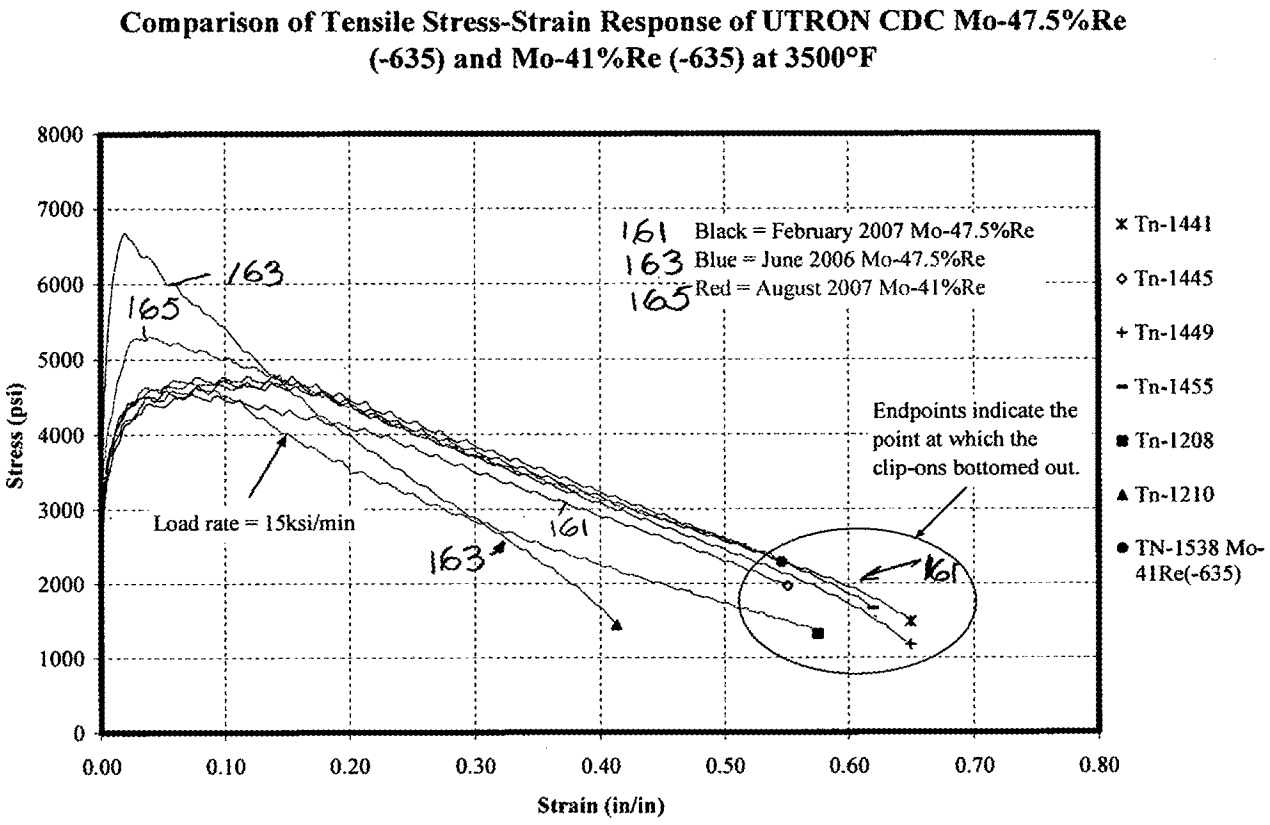
Figure 19b. High Temperature Mechanical Test Results

High Temperature Mechanical Test
Results-Tensile Samples After 3500 F Testing

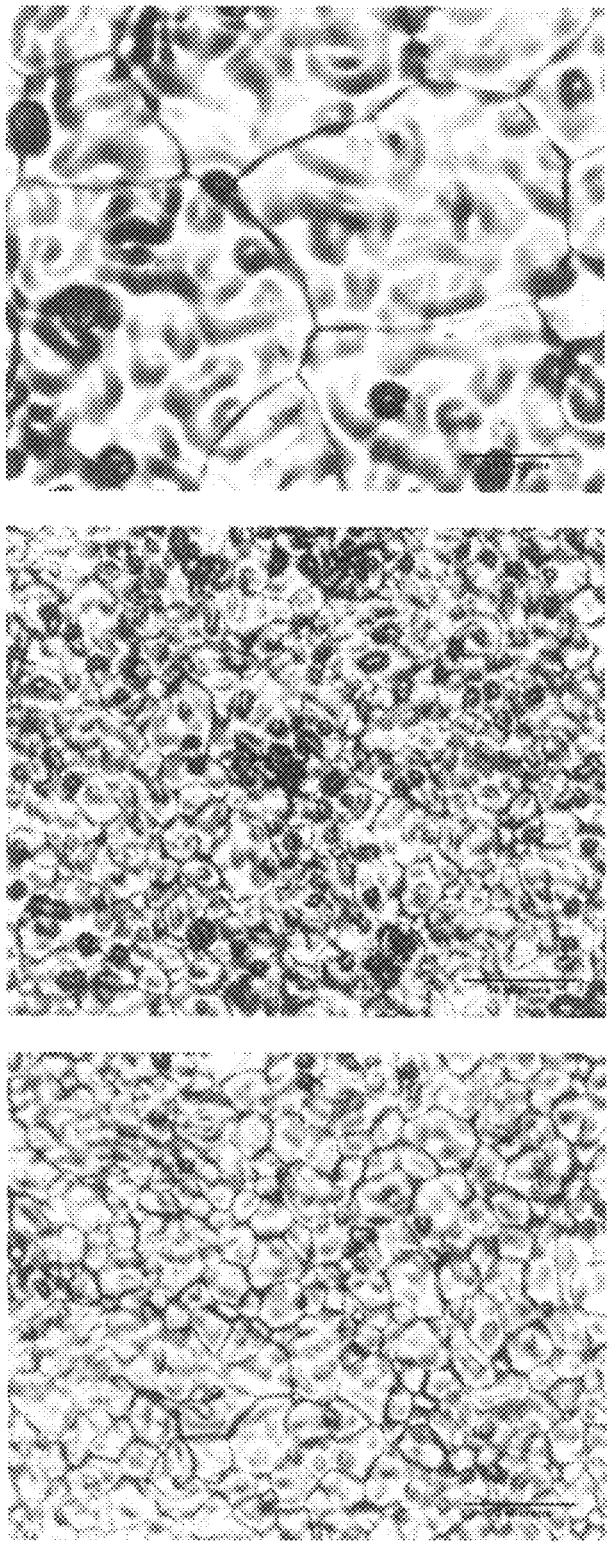
Figure 20.a Microstructures of CDC Compacted and Optimally Sintered Mechanical Test Sample Microstructures- Samples 1538, 1539, 1540.

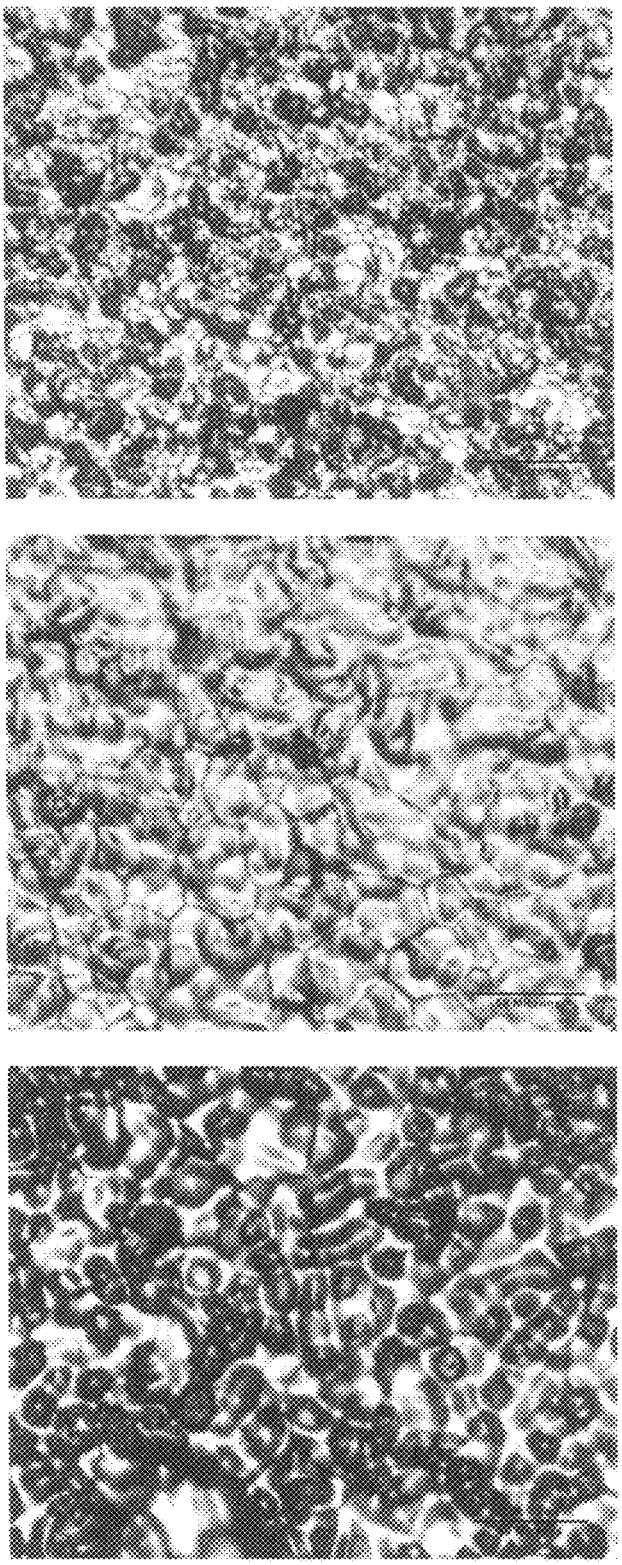
Figure 20. b. Microstructures of CDC Compacted and Optimally Sintered Mechanical Test Sample Microstructures- Samples 1541, 1542, 1543

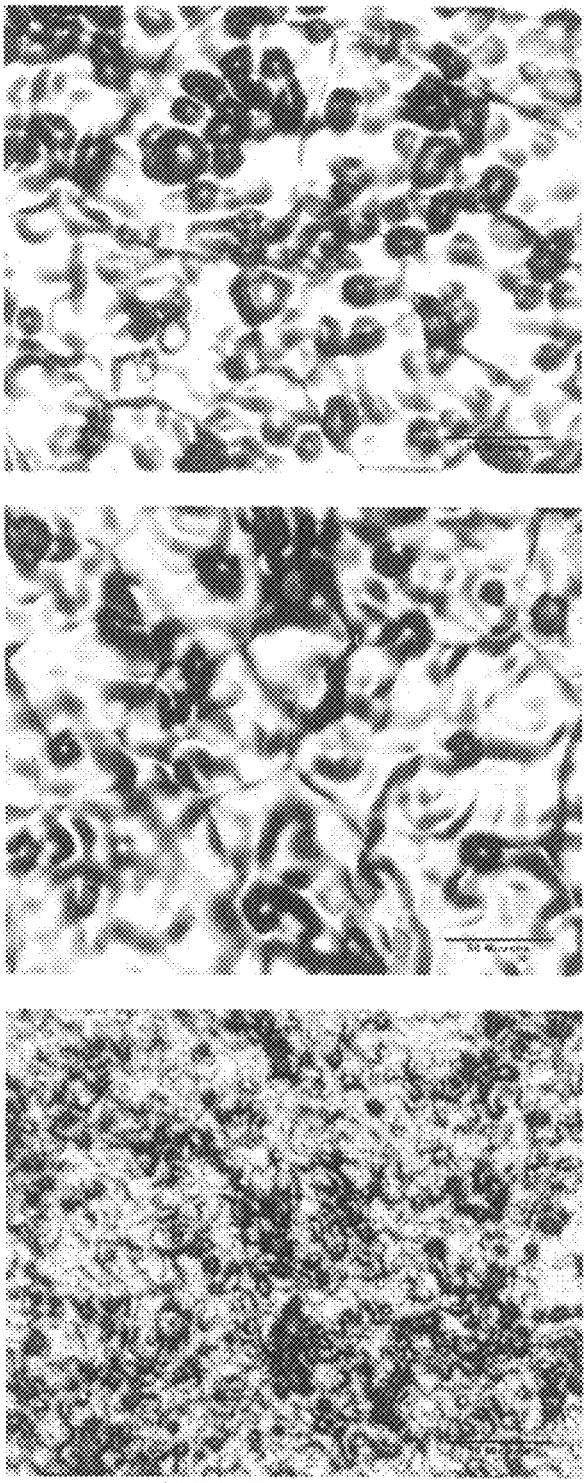
Figure 20. c. Microstructures of CDC Compacted and Optimally Sintered Mechanical Test Sample Microstructures- Samples 1544, 1545, 1546.

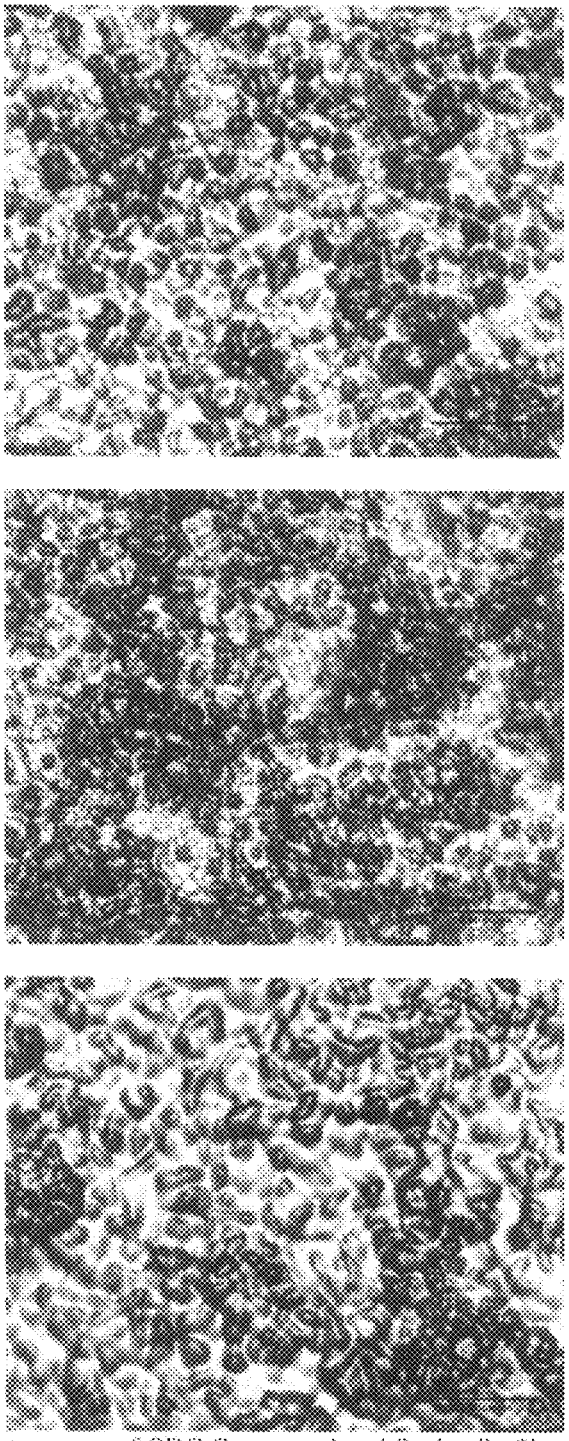
Figure 20. d. Microstructures of CDC Compacted and Optimally Sintered Mechanical Test Sample Microstructures- Samples 1547, 1548, 1549.

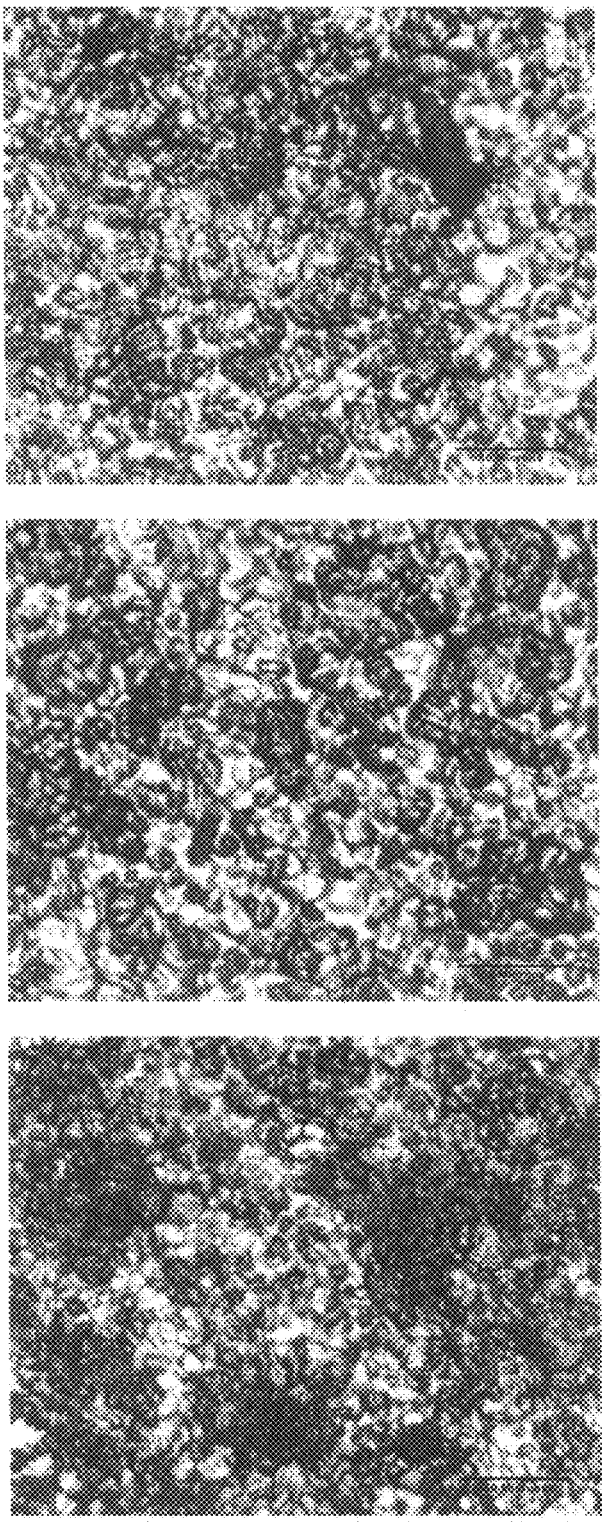
Figure 20. e. Microstructures of CDC Compacted and Optimally Sintered Mechanical Test Sample Microstructures- Samples 1550, 1551, 1552.

20x Lens, Scale 10microns/division.
(Micron Scale Used in the Microstructures for Fig. 20)

NEAR NET SHAPE COMBUSTION DRIVEN COMPACTION PROCESS AND REFRACTORY COMPOSITE MATERIAL FOR HIGH TEMPERATURE APPLICATIONS

This application claims the benefit of U.S. Provisional Application No. 60/853,360 filed Oct. 20, 2006, which is hereby incorporated by reference in its entirety.

This invention was made with Government support under Contract HG0006-05-C-7224, awarded by the Missile Defense Agency. The government has certain rights in this invention.

FIELD OF THE INVENTION

The present invention relates in general to the high-pressure fabrication of materials.

BACKGROUND OF THE INVENTION

Various advanced high temperature components require varying high temperature properties and durability. Some systems use solid propellants while others use liquids. This includes aluminized (e.g., tantalum carbide suitable material) as well as non-aluminized propellant systems (Mo/Re, W—Re and Re alloys) as well. Material choices are therefore crucial. In either case, the components are subjected to extreme erosive conditions of heat (several thousands of deg F.) and flow velocity. Solutions generally require high performance refractory or refractory based ceramic composite materials with better durability, minimal number of processing steps, and high temperature strength/ductility properties and demand faster and cost-effective production processes.

Vapor deposition techniques are relatively slow and expensive and involve intermediate multi-steps to obtain the near net shape product. Plasma processes have porosity present inherently (e.g., 5 to 15% are typical). Conventional powder metallurgical pressing technology is limited by relatively lower compaction pressures (e.g., <50 tsi) that limits the densification process, with much higher part shrinkages requiring several post-process steps to improve the properties and obtain the final geometry.

The manufacture of the high temperature resistant refractory matrix materials such as Re or Re—W with Hf, Zr or ceramic carbides of Hf-and Ta, in near net shaping with improved properties and surface quality is challenging, time consuming, labor-intensive and costly which demand innovative manufacturing and strategies.

High temperature components have various shapes such as cylindrical disk, rings, plates, or hollow cylinder etc depending on the application. Some high temperature structural parts are made of carbon/carbon (C/C) or carbon/silicon carbide (C/SiC) composites due to their high temperature strength and lightweight properties. However, the oxidation behavior of C/C based composites at temperatures >450-500 deg C. still poses some limitations and demands alternate protective materials against oxidation and erosion.

There have been crucial needs to improve the durability and minimize the manufacturing time and cost in fabricating refractory disks used in the hot section catalyst bed plate components

SUMMARY OF THE INVENTION

In a new combustion driven compaction process, a chamber, powder, a piston or ram, and a gas supply are provided. The chamber is filled with a mixture of natural gas and air and the gas supply is closed. The gas is combusted, causing the pressure in the chamber to rise and exert force on the piston or ram. The powder is then compressed into an intended shape. To pre-compress, and remove entrapped air from, the powder, the piston or ram is pressed against the powder as the chamber is being filled with natural gas and air. The pre-combustion load on the powder may be 15 to 20 tsi.

A die may be provided and the powder may be held in the die. The piston or ram is in the chamber and to compress the powder the piston or ram is pushed into the die and against the powder. The die walls may be lubricated. The peak load on the powder may be about 250 tsi or greater. The peak load on the powder may occur within 250 ms of the initiation of combustion. The peak load on the powder may be a direct function of combustion pressure and the area of the piston or ram. The high pressure and temperature exhaust gases produced during combustion may be used for other press operations.

The process of claim 1 may produce only about 5% or less scrap metal. The powder compression can bond refractory tantalum to aluminum substrate. After compression, the shaped powder may be sintered in hydrogen. The powder provided may be metal powder with a fineness determined by the acceptable shrinkage of the compressed powder. The powder provided may include about 1 wt % to 5 wt % hafnium to reduce shrinkage of the compressed powder. The powder provided may be Mo/Re with 2-12.5 wt % HfC and/or a concentration of about 1 wt % to about 5 wt % Hf necessary to produce a desired strength. The powder may be −635 mesh or finer (<20 microns).

The powder may be compressed with a force of about 150 tsi. The intended shape may be a near net shape.

A material made by the new combustion driven compaction process has improved density, strength, and % elongation compared to materials made by traditional powder metallurgy. It may be a Mo/Re alloy with Hf or HfC, exhibiting a strength of about 40,000 psi or more at 2500° F. The material may have surface quality in microns or sub-microns and ductility equivalent or better than wrought metals. The material may contain a material selected from the group consisting of Mo/Re, HfC, TaC, SiC, Molybdenum, Niobium-based alloys, hafnium borides, boron carbides, and other borides and silicides with carbon. The material may contain Mo/Re base alloy with HfC and Hf. The material may have a green density of 75-82% of theoretical and a sintered density of 93-98% of theoretical density.

The material may have less shrinkage during sintering compared to materials made by traditional powder metallurgy. The material after sintering may have good bonding, no cracking, fine surface quality, higher densification and superior mechanical properties compared to traditionally compacted and sintered powder metallurgy materials, and comparable strength and ductility to wrought annealed materials both at room temperature and high temperatures up to 3500° F. The material may have a strength of 135 ksi or more, ductility of 30% or more, hardness of 315 VHN or greater, or a polycrystalline microstructure. The material may have as an average grain size of <64 microns after sintering.

The material may have functional gradient structures of several layers of differing materials and composites. The material may have a high temperature resistant refractory matrix material.

A new combustion driven compaction apparatus has a chamber, a piston or ram, a gas inlet in the chamber, wherein combustion of gas in the chamber pushes the piston or ram. The apparatus may also have an igniter in the chamber for combusting the gas. The apparatus may also have a die, wherein when the piston or ram is pushed outward from the chamber it pushes into the die. One side of the die may be closed by a punch tool. The apparatus may have only one moving part. The apparatus may be less than eight feet long in any dimension and produce a force of 300 tsi with the piston or ram. Such an apparatus may be able to be moved with a standard forklift. The apparatus may be capable of producing a force of 3000 tsi with the piston or ram and still be about 9' high, 6' wide, and 4' deep. Such an apparatus may also be able to be moved with a standard forklift.

These and further and other objects and features of the invention are apparent in the disclosure, which includes the above and ongoing written specification, with the drawings.

BRIEF DESCRIPTION OF THE DRAWINGS

FIG. 1*a* shows Ceramic Materials for High Temperature Applications.

FIG. 1*b* shows Mechanical Properties of Refractory Materials as a Function of Temperatures.

FIG. 2 shows the basic CDC process.

FIG. 3 shows a Typical CDC Compaction Load.

FIG. 5 describes Percentage of Scrap vs. Manufacturing Process, CDC Copper and Stainless Steel. Rings and Selected Material Properties.

FIG. 6 shows CDC Compacted Variety of Other Geometries Processed with Near Net Shape Finish/Surface Quality Attributes.

FIG. 10 shows Microstructures of Hydrogen Sintered CDC ReMo Samples.

FIG. 11 shows Microstructures of Hydrogen Sintered CDC ReMo—Hf—HfC Composite Samples.

FIG. 17 is X-ray EDS Dot Maps of Mo, Hf, Re and O in Mo/Re/12.5 HfC Microstructures.

FIGS. 19*a-c* is a diagram showing High Temperature Mechanical Test Results.

FIGS. 20*a-f* show microstructures.

DETAILED DESCRIPTION OF THE INVENTION

Figure 4A:
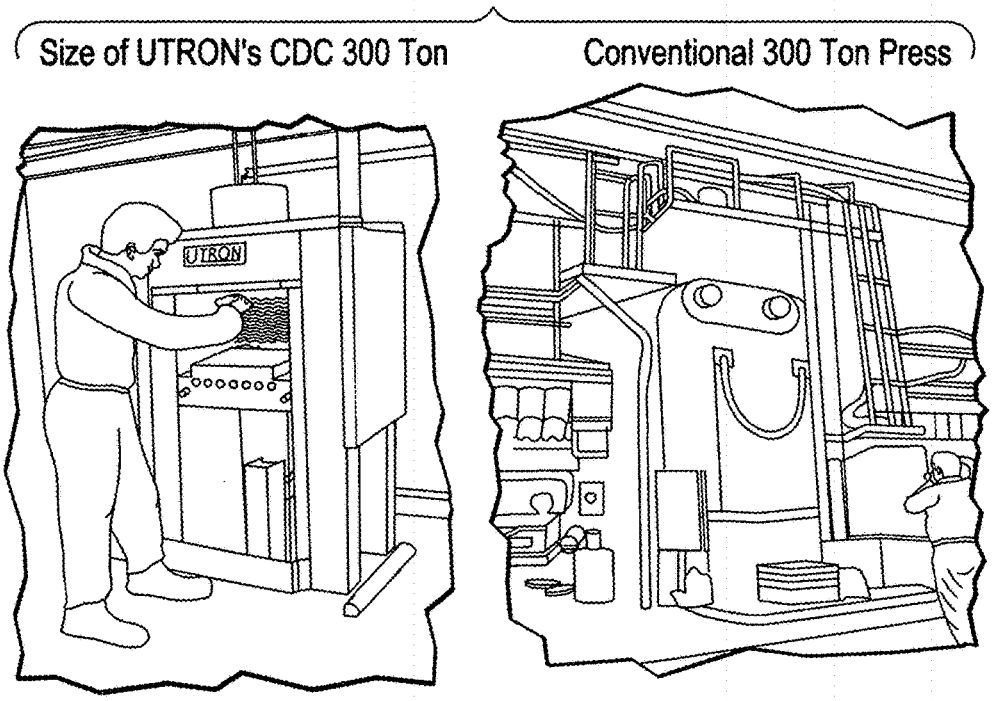
FIG. 4*a* shows Compactment of CDC Press with Traditional Press.
Figure 4B:
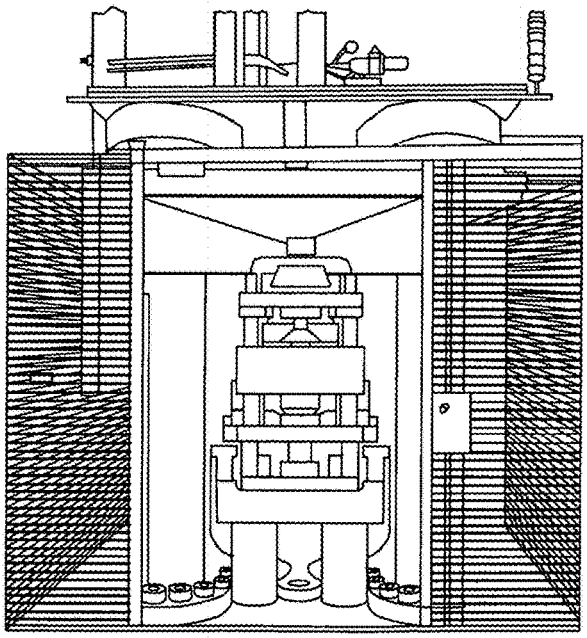
FIG. 4*b* shows a Scaled Up Version of Newly Assembled 1000 Ton CDC Press.

Innovative approaches allow economically feasible acquisition of new manufacturing process technologies and unique refractory composite materials for advanced high temperature components in ballistic missile defense systems. Cost-effective and rapid fabrication process technology facilitates transition of high performance, near net shape and reliable prototypes from a research and development environment to a manufacturing environment.

One such process technology—the high pressure Combustion Driven Powder Compaction (CDC) technology can be used to manufacture denser, durable near net shape components with improved properties. CDC produces components such as plenum or inlet, pintles, valves, and manifolds with much higher green and sintered densities, much less part shrinkage after sintering and superior surface quality (e.g., microns to sub-microns of average roughness are typical), less post-process machining or materials wastage (Table 1), and near net shapes of simple to complex geometry (FIG. 6).

CDC uses a minimal number of steps and has competitively lower manufacturing costs compared to the traditional fabrication methods such as multi-step Conventional Powder Metallurgy (usually limited to <50-55 tsi compaction pressures), Casting/Forging, Chemical Vapor Deposition (CVD), Chemical Vapor Infiltration (CVI) and Vacuum Plasma Processing (VPS) methods for its advanced propulsion systems.

In response to high temperature propulsion materials, innovative near net shape fabrication technology has been developed with tremendous potential for cost-effective manufacturing, minimal or no wastage of expensive and exotic raw materials such as Molybdenum-Rhenium (Mo/Re) based composite alloys and rapid manufacturing (e.g., milliseconds of compaction time) method called high pressure Combustion Driven Powder Compaction (CDC) technology.

Potential Mo/Re-X-Y composite materials (e.g., X=Hf; and Y=HfC) have been fabricated all with CDC method in net shape with higher densification and improved mechanical properties at elevated temperatures (e.g., 3500 F or higher). Testing of CDC processed Mo/Re alloys indicated excellent results up to temperatures at 3500 deg F. (FIG. 7).

The CDC high pressure (up to 150 tsi) and faster (few hundred milliseconds) compaction with controlled gentler loading profile are desirable attributes to consolidate variety of micro/nano powders to obtain much higher green and sintered part densities with near net shapes of simple to complex geometry. Other process advantages of CDC processing for refractory Mo/Re alloys with Hf, $Ta_2C$, HfC nozzle components are competitively lower manufacturing costs, minimal wastage (FIG. 5) of expensive raw powder materials, less shrinkage, and minimal texturing effects as commonly found in traditionally rolled materials, compared to the traditional fabrication methods such as Traditional power metallurgy at <50 tsi compaction pressures, hot pressing/extrusion, Vacuum Plasma Processing (VPS), HIPing, Chemical Vapor Deposition (CVD), Chemical Vapor Infiltration (CVI), and Molding/Casting for potential high temperature system applications.

The high pressure CDC Compaction overcomes several processing challenges with its milliseconds of part pressing time, much higher compaction pressures (up to 150 tsi) and gentler loading profiles (FIG. 5) to improve the densification of variety of engineering materials (FIG. 7) including near net-shaped ceramics. Some of the latest results of CDC copper and stainless steel samples indicate high density, superior surface finish/quality, and better mechanical properties and leak resistance comparable to those of wrought/cast materials.

Issues with fabricating refractory disks used in the hot section catalyst bed plate components are overcome using the high pressure CDC manufacturing. Using fine grained Mo/Rhenium or Re/W alloys with other alloys such as Hf, HfC or Ta2C using commercially available finer powders and careful CDC process optimization, property evaluation and sintering responses, small scale disks and mechanical test samples were fabricated using a 300 Ton Press and representative 2 inch diameter disks were done using a 1000 ton CDC press. Other advanced alloys were fabricated such as Mo/Re with Iridium to further improve the oxidation protection and scale up to fabricate other geometries using the 1000 Ton Press.

Hafnium (which has density of 13.31 g/cc and melting point of 2230 deg C.) was used for CDC refractory composites developed in this innovation to provide high temperature protection up to temperatures (e.g., 2100 deg C. just below its melting point) as well as strengthening for the Mo/Re base matrix alloy. The mechanically blended Mo/Re base alloy (with calculated theoretical density of 13.5 g/cc and melting point of 2450 using simple rule of mixtures), as used in our CDC compaction experiments has a composition of 52.5 Mo-47.5 Re, as provided by the powder vendor (weight %). The powders were then mechanically blended with Hf and HfC in the glove box with Inert gas control at the CDC processing set up.

While FIG. 1*a* shows the high temperature behavior of ceramics, FIG. 1*b* shows the mechanical properties of refractory metals as a function of temperature. It is seen that rhenium (Melting Point of 3180 deg C.) has the highest strength and modulus of elasticity compared to other refractory metals such as tungsten, molybdenum, tantalum, and niobium with melting points, 3410, 2610, 2996, and 2468 deg C., respectively.

PM processing and CDC in particular can improve the high-temperature properties of Re—W alloys by their ability to disperse other harder and higher-melting carbides such as HfC, TaC. CDC at high pressures at 150 tsi has the ability to generate desired finer and uniform microstructures containing such carbides leading to better high-temperature properties. Some of the carbide based materials are used for protecting carbon-carbon composites in high temperature propulsion systems. It is evident that materials such as HfC, TaC, HfN, and $HfB_2$ have the desired high melting temperatures and potential to serve as ceramic reinforcing materials for refractory based metal matrix composite nozzles such as TZM, Mo/Re and Re—W alloys. The key issues are to match the linear thermal expansion of the composite to prevent thermal cracking/shocking and improve density and interfacial mechanical bonding/thermal shock resistance at higher temperatures.

Near Net-shaping tungsten, molybdenum, Mo/Re alloys (FIGS. 7*a* an *b*) and TZM disks (0.5 inch diameter) with relatively high sintered densities (up to 96-98%) including some Re— and Re—Mo materials with Hf, and Hf, some AlN ceramic, SiC and metal-matrix composites (e.g., Cu/AlN) were successfully compacted and produced at 150 tsi without cracking using intelligent powder alloys and compaction. The use of boron carbides and hafnium carbides have shown better thermal cyclic behavior as compared to SiC in some studies indicating the need to further develop similar competitive alloys in composite form. Compared to the oxides, carbides and nitrides have much higher melting temperatures.

The use of Mo/Re based composites with strengthening composite reinforcing materials such as Hf and carbides such as HfC, is highly desirable for very high temperature applications. The present invention produces cost-effective, and competitive Mo/Re based composite alloys with and without Hf and HfC with select compositions in the near net shape form with two steps of manufacturing. Innovative high pressure CDC powder compaction at 150 tsi and optimal thermal sintering are used to obtain relatively higher green and sintered part densities, sub-micron surface quality, less part shrinkage characteristics, fine grained microstructures, and excellent strength/ductility attributes with comparable annealed material properties at temperatures up to 3500 deg F.

The potential erosion resistant materials are refractories such as W—Re, Re or Re/Mo and or ceramic composites with carbides, nitrides, and borides such as TaC, HfC, HfN, $HfB_2$, $ZrB_2$, $TiB_2$, SiC, or $B_4C$ depending on the type of material properties for high temperature protection (Tables 1 and 2 and FIGS. 1*a* and *b*). The potential materials for high temperature components are rhenium based alloys such as molybdenum/rhenium and functional gradient Mo/Re ceramic composites with carbides and borides such as TaC, HfC, $HfB_2$, $ZrB_2$, $TiB_2$, SiC, or $B_4C$ in the decreasing order of melting points for high temperature protection. Rhenium's linear thermal expansion ($6.7\times10^{-6}$/deg) is very compatible with carbides. Also Rhenium is not a carbide former which is an added advantage.

Other additional composite additional material such as Hafnium (which has density of 13.31 g/cc and melting point of 2230 deg C.) used for CDC refractory composites developed in this innovation is desirable to provide high temperature protection up to temperatures (e.g., 2100 deg C. just below its melting point) as well as strengthening for the Mo/Re base matrix alloy.

The CDC Process

Combustion Driven Compaction (CDC) utilizes the controlled release of energy from combustion of natural gas and air to compact powders. In operation the following steps occur: Fill chamber to high pressure with a mixture of natural gas and air; As the chamber is being filled the piston or ram is allowed to move down pre-compressing and removing entrapped air from the powder; The gas supply is closed and an ignition stimulus is applied causing the pressure in the chamber to rise dramatically, further compressing the metal powder to its final net shape.

The basic CDC process is shown in FIG. 2. The CDC process is unique in utilizing the direct conversion of chemical energy to produce compaction. In addition, the process inherently includes a pre-compaction step preparing the powder for the final compaction load. The CDC process can provide standard or very high compaction tonnages resulting in very high-density parts with improved mechanical properties. In addition to the unique loading sequence and high tonnage the process occurs over a relatively short time frame (a few hundred milliseconds). A typical CDC produced load shown in FIG. 3 illustrates the faster process cycle time.

A CDC press is compact and uncomplicated. For example, a 4137 MPa (300-ton) mechanical or hydraulic press is typically two or more building floors tall and has many moving parts and/or complex hydraulics. A 300-ton rated CDC based press is not much larger than a phone booth and has one moving part. The compact prototype CDC 300-400 ton rated press is shown with traditionally used much larger conventional press in FIG. 4*a*.

As a general rule as the compressive load applied to a powder metal is raised the compact density and green and sintered part properties improve. However, if the powder is compressed too rapidly or violently, shock propagation in some materials can cause internal cracks and separations (over-pressing).

CDC Press Scaling

As previously mentioned, since the CDC press directly converts chemical energy into compaction energy it is very energy efficient and capable of producing enormous compaction loads. To date three presses of increasing size have been constructed and operated, 10, 30, 300 and 1000 ton. The CDC compact press has the potential for scaling up further up to 3000 Ton capacity without compromising its compactness, unlike the traditional presses. Scaling from one size to the next is relatively straightforward. Since the process works more or less like a piston in an automobile, although at much higher pressures, the loads that can be produced are a direct function of the combustion pressure and the area of the ram (piston). It is possible then to scale a CDC press to very high tonnages without increasing the size of the press itself dramatically. As an example a 3000 ton CDC press would only be about 2.75 m high, 1.92 m wide, and 1.28 m deep (9 ft×6 ft×4 ft).

There are other engineering issues associated with producing a "high rate" production version of a CDC press. These issues include rapid filling of propellant gases, rapid venting of combustion gases, purging of water produced in the chamber, active cooling of the chamber if necessary, and robust repetitive high-pressure ignition. These issues have largely been resolved and tested. Powder feeders and part conveyers can be readily adapted from off-the-shelf components.

It is interesting to note that the high pressure and temperature exhaust gases produced during combustion in the CDC can be used for other press operations such as part extraction or running other ancillary equipment, further increasing the efficiency of the press. The relatively diminutive size of a CDC press allows powder metal part making to be performed in almost any industrial or commercial building with access to bottled or piped natural gas. Pits and multi-story buildings are not needed, and the presses can be moved with standard forklifts. This relative portability allows, for instance, powder metal presses to be incorporated into "machining centers" as needed and then moved to other centers or sites generally without special equipment.

Properties of CDC Produced Compacts

The CDC process operates at compaction loads of 15 to 150-tsi and above. It is well known that compaction tonnage generally makes a large difference in the final quality of the compacted part, both in the green (unsintered state) and in the sintered state. Another benefit of high part density is lack of dimensional change (shrinkage) when the material is sintered. In many materials pressed by the CDC process at high tonnage there is no measurable change in pre versus post sintering density. The elongation or "toughness" of samples produced with the CDC process is particularly exceptional, often approaching that of comparable non-powdered metals.

The low % of scrap metals in P/M process (FIG. 5) compared to other manufacturing processes is unique. Select results of density, surface roughness and hardness of CDC samples of Al—Mg, Steel, Stainless Steel and Copper reveal higher density, smoother surface finish and stronger materials properties. The superior surface quality of CDC copper and stainless steels is evident from FIG. 5 as well as the ring geometry typical for inserts. Aluminum Nitride and SiC ceramics in cylindrical slugs have been fabricated using high pressure compaction with much higher green densities (e.g., 70 to 80%) followed by higher sintered densities (e.g., 97.5% in CDC SiC) and excellent surface finish.

CDC samples have been produced with enhanced material properties such as density, strength and % elongation compared to those made by traditional powder metallurgy method. Single and Multi-component layered compacts have been produced with the CDC process in many combinations including: Al/Al2O3, Ti/Al, Ta/410 SS, Mo/410 SS, Ti/316L, Ta/Steel, Ta/Cu, and Cu/Steel. The representative geometries fabricated include cylinders, rings, and dogbones. Mo/Re alloys with Hf and HfC and optimized in preliminary conditions for obtaining strengths of ~40,000 psi at 2500F have been successfully fabricated. FIGS. 6 and 7 reveal other geometries that have been successfully produced using this CDC process.

The superior surface quality in microns or sub-microns and mechanical/ductility equivalent or better than wrought metals have been obtained on several geometries of materials at higher CDC compaction pressures under optimum process conditions. CDC compacted and sintered various refractories such as tungsten, molybdenum, Re, Mo—Re alloys (Table 3 and FIGS. 8 and 9) and Hf, HfC alloys have been produced with near net shape, sub-micron surface finishes, much higher densities and part properties for potential x-ray target and propulsion system entrance applications. CDC processing has demonstrated that refractory tantalum can be bonded to aluminum substrate by high pressure solid-state compaction/sintering using intelligent choice of powder selection and compaction process parameters.

Summary of CDC Benefits

A new press technology based on the direct conversion of chemical energy from natural gas and air combustion is called Combustion Driven Compaction or CDC. The press has three main attributes: First, owning to its high efficiency and unique design, it is very compact relative to other press technologies. A CDC based press is a fraction of the size of a conventional press with the same load capability. Secondly, due to its distinctive loading cycle, the press is capable of delivering "standard" or very high compaction loads without damaging die components or producing cracks in the compacts. Finally, compacts made at high loads in the CDC process with only die wall lubrication display greatly enhanced mechanical properties before and after sintering.

Anticipated Benefits

The potential applications for the proposed CDC technology include Catalyst BedPlates, refractory and ceramic composite inserts, military ammunitions/projectiles/heat shields, gyroscopes, ignitor components, electronic packaging/aerospace components, x-ray targets/tubes (e.g., Tungsten-Rhenium or Moly Alloys), high performance welding and glass melting electrodes, RF damage resistant refractory components for linear collider copper disk structures, boring bars/tools, high temperature dies, brazing fixtures, electrical contacts. Other applications of CDC processing include superconducting accelerator components, couplers, low temperature vacuum seals (e.g. Al—Mg alloys), and nuclear plasma components. Other commercial applications include ball and roller bearings, permanent/superconducting magnets, microelectronic packaging interconnects, sputtering/x-ray targets with conductive copper backing, mould dies with tough steel/copper backing, automotive piston rings, valve seats, gears, high temperature composite bearings, microwave appliances, cutting tools, and other wear/corrosion resistant tribological components.

Significance of the Proposed Research

With greater demands for superior high temperature erosion resistance and protect the C/C or C/SiC composite materials used in components, the needs for cost-effective fabrication in near net shape form and development of suitable high performance, well-bonded refractory based functional gradient composite materials are demanding and crucial. An innovative high pressure CDC powder compaction in near net shape has been used to manufacture small scale parts and select ring and dogbone geometries made of rhenium, molybdenum/rhenium and rhenium/high temperature carbide composites.

Mo/Rhenium and select composite alloys of HfC, TaC and SiC and other advanced alloy composites can be used based on their high temperature properties such as Molybdenum, Niobium-based alloys, hafnium borides, boron carbides, and other borides and silicides with some carbon for absorbing the strains by few % (Table 2 and Table 3) and needs of potential insertion capability with ongoing nozzle and other applications. With the availability of select micro/nano powders in the commercial markets, CDC high pressure compaction is unique to produce high performance, dense, and simple/complex composite parts in both micron and nano structured form by faster (e.g., milliseconds) consolidation.

Such a systematic innovative approach will significantly contribute to improving the efficiency, component design, durability and performance of parts and components. The science of CDC processed powder materials is an emerging research field of critical importance and scientific value.

Experimental Materials, Procedures and Results

Powder Materials Used:

- Re (−200 mesh; ~<74 microns); 52.5 Mo-47.5 Re (−200 mesh; ~<74 microns)
- W—Re alloy; Mo-41 Re alloy; W-25 Re
- Select Samples with Re (−635 mesh; ~<20 microns); 52.5Mo/47.5Re (−635 mesh; ~<20 microns)
- 50% Coarser and 50% Finer Powder Alloys of Re/Mo
- Re and Mo/Re Alloys with Hf (1% and 5%)
- Re and Mo/Re Alloys with 1% Hf, 2 HfC and some with Higher % of HfC (12.5%)
  - Hf Powder (−325 mesh, ~<44 microns) & HfC Powder (−325 mesh, '<44 microns)

CDC Compaction Process Conditions

- (CDC Pressure for Pressing/Compaction @150 tsi and Diewall Lubricant: Zinc Stearate
- Type of Geometries Successfully Fabricated:
- 0.5 inch dia disks, 3.5 inch long tensile dogbones with select thickness; and 0.5 inch OD Hollow Rings
- Die/Punch For Making Small Scale High Temperature System Parts (The Die/Punch Tooling
- has been designed and procured for the Fabrication of small scale high temperature parts)

Sintering Experiments of CDC Samples in Hydrogen

- (at Test Temperatures of ~1800, ~2100 and ~2300 deg C.)

Geometrical Properties (Thickness, Width, Length (for dogbones) Diameter, Thickness (disks), ID, OD (Rings)

Green Densities (e.g., 75 to 85.44%) and Sintered Densities (e.g., 93 to ~98% depending on the composite alloy compositions and various sintering conditions)

Shrinkage Properties: Mo/Re: ~<4.6 to 4.8%; Rhenium: ~<7 to 9% depending on sintering Mechanical Properties at Room Temperature Microstructural Properties of Sintered Samples X-Ray EDS Microchemistry of Sintered Samples X-ray Non-Destructive Imaging of Select Tensile Samples High Temperature Mechanical (e.g., 2500 and 3500 deg F.) Test Results of CDC Compacted and Optimally Sintered Tensile Samples Physical and Geometrical Properties Select key results of the physical and geometrical properties of Green (Table 4a-k, Table 6, Table 13) and Hydrogen Sintered CDC samples (Table 5, Table 7, tables 8-12) are provided. The alloys processed include Mo/Re, Re and alloys with Hf and HfC of various compositions. In general the green (75 to 82% of theoretical) and sintered densities (93 to 97% of theoretical densities) were relatively higher due to high pressure compaction at 150 tsi than those obtained normally with traditional powder metallurgical techniques.

Figure 9:
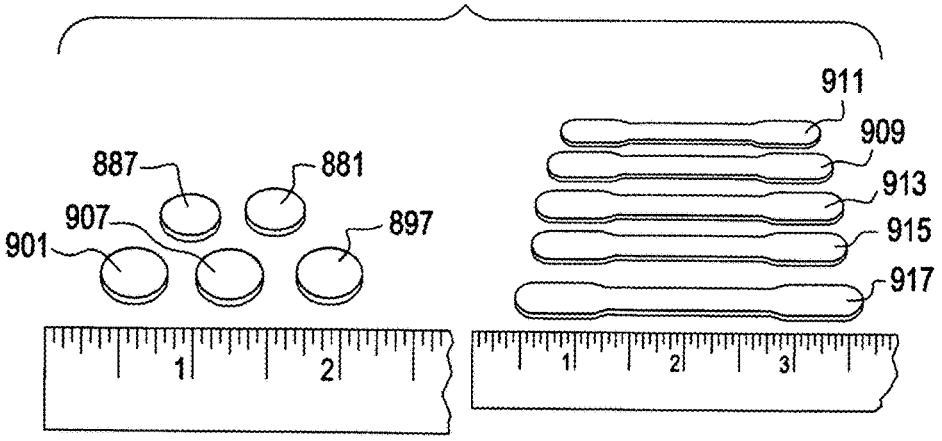
FIG. 9 is Hydrogen Sintered CDC Disk and Tensile Dogbone Samples.
Figure 8A:
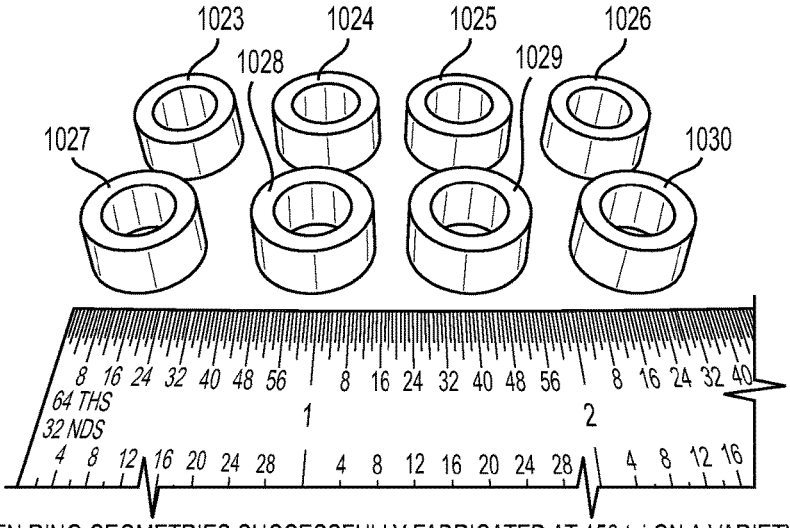
FIG. 8*a* shows Green Ring Geometries Successfully Fabricated at 150 tsi on a Variety of Re/Mo Alloys with Hf and HfC.
Figure 8B:
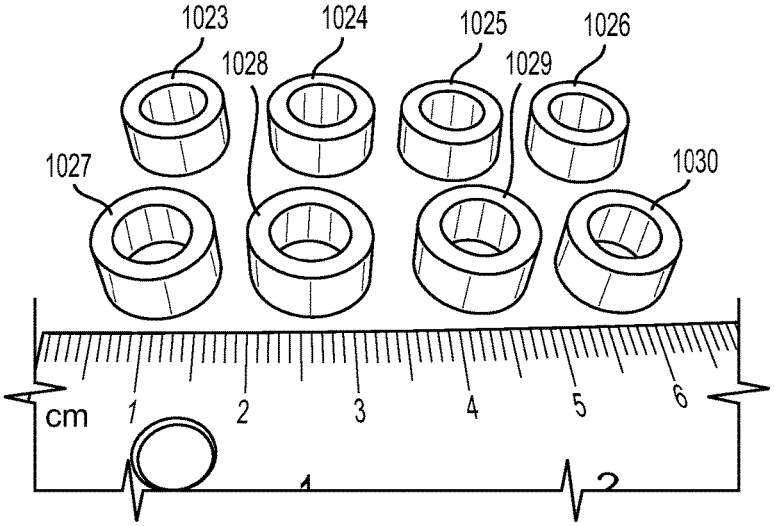
FIG. 8*b* shows Sample #1023 1024, 1025, 1027, 1028, 1029, 1030 Sintered Ring Samples.

The hydrogen sintered samples, in general, were well-bonded, free-from cracking, of smooth surface finish and of near net shape quality. The near net shaping ability is demonstrated (FIGS. 8 and 9). The fine surface finishes are characteristics of CDC high pressure compaction (Table 14). The crack-free nature has indicated the need for unique faster loading cycle (FIG. 3) and the right powder selection/morphology.

The Rhenium samples were found to reveal relatively higher shrinkage (~7-9%, depending on the thickness, width or length dimensions) compared to Mo/Re alloys. (Tables 10-12). The addition of Hafnium (e.g., 5%) was found to decrease the shrinkage characteristics significantly.

The Finer powder sintered samples of Mo/Re (sample#963) revealed relatively lower shrinkage than coarser powder sintered (Sample#969 and 970) samples.

Powder Selection and Morphology

The powder specifications include: Powders of various refractory powdered materials, for example 52.5 Mo-47.5 Re powder with −200 mesh, W-25 Re alloy systems with −635 mesh, Mo-41Re and rhenium with −200 mesh, Hafnium powder with −325 mesh (44 microns or smaller) and 99.6% purity, and Hafnium carbide powder with −325 mesh with 1-4 microns of average size. The powder morphologies were evaluated using microscopy. The distribution, range of sizes within the mesh designation and non-spherical shape of the powders were evident and desirable for compaction. In addition, tensile dogbone samples have been fabricated using powders of fine mesh, for example −635 mesh size powders of Re and Re/Mo. (Tables 6a and 7).

Sintering Responses:

The sintering experiments at 1800, 2100 and 2300 deg C. in hydrogen were carried out on select CDC samples. The sintering responses of samples revealed higher densification, good bonding, no cracking, fine surface quality and comparable mechanical properties of strength and ductility under optimum sintering to those of wrought annealed materials. In fact, the high temperature sintering of CDC samples has improved the densification significantly and mechanical properties as compared to those traditionally compacted and sintered P/M materials.

Samples sintered at 2100-2120 deg C. indicated higher sintered densities up to 97% of theoretical value than those sintered at lower sintering temperature at 1800 deg C.

The evaluation of the densities of cylindrical disk samples sintered in Hydrogen at 2300 deg C. for 4 hours have been completed. The sintered density results are presented as follows:

| | | | |
|---|---|---|---|
| Re Disk: | #902 | 20.529 g/cc | 97.67% of Theoretical Density |
| Re/1 Hf | #900 | 20.183 g/cc | 96.58% of Theoretical Density |
| Mo/Re Disk: | #904 | 13.267 g/cc | 94.80% of Theoretical Density |
| Mo/Re/1 Hf | #906 | 13.068 g/cc | 93.43% of Theoretical Density |
| Mo/Re/12.5 Hf | #894 | 11.349 g/cc | 82.15% of Theoretical Density |

The ring sample #953 (fabricated with −200 mesh powder) had a sintered density of 13.154 g/cc (93.99% of theoretical density) and sample#954 (fabricated with 50% of −200 mesh powder and 50% of −635 mesh powder) had a sintered density of 12.956 g/cc (92.58% of theoretical density). The shrinkage values of ring samples (Table 12) were relatively lower than those obtained in tensile dogbones (Table 10-11).

As indicated previously, high sintered densities of optimum alloy compositions (e.g., Re, Mo/Re and alloys with low Hf % and HfC) are unique attributes of high pressure CDC compaction. These results also indicate the significance and dire scientific needs for further process optimization in our continuing efforts as of submitting this patent application submission.

Room Temperature and High Temperature Tensile Testing and Results

Figure 12:
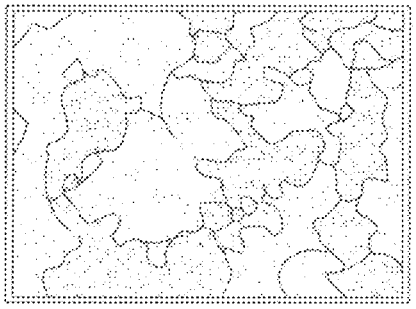
FIG. 12 is a Sintered 52.5 Mo-47.5 Re Disk –H2 Sinter-2100; 14 hours.
Figure 13:
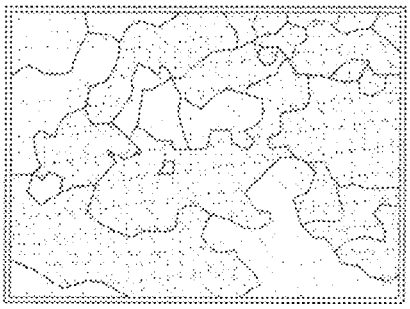
FIG. 13 is a Sintered 52.5 Mo-47.5 Re-1 Hf H2 Sinter-2100; 14 hours.
Figure 14:
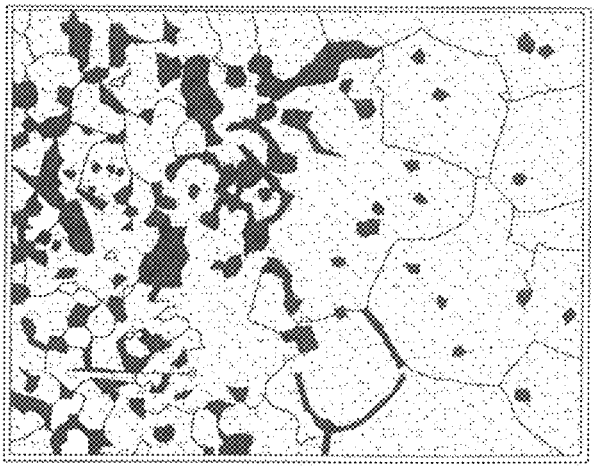
FIG. 14 is a Sintered CDC Mo—Re-12.5 HfC H2 Sinter-2100 DegC; 14 hours.

The room temperature tensile tests of CDC compacted and sintered dogbone samples (Tables 14-16 and FIGS. 12-14) were conducted at a cross head speed (chs) of 0.1 in/min. up to 0.4% offset strain. The extensometer is removed at this time to avoid damage when the specimen fails. The speed is then increased to 0.3 in/min chs until the specimen fails. The original gage length was marked on the samples with ink to avoid stress concentrations associated with regular gage mark indentions. After the sample had failed, the fractured ends of the samples were carefully placed together and any increase in length (between the gage marks) was measured. The Hafnium and Hafnium Carbide were beneficial to improve the strength properties significantly. Re/Mo alloys revealed significant necking indicating excellent ductility in CDC parts similar to traditionally annealed wrought parts.

CDC Process Optimized Tensile Dogbones for High Temperature Mechanical Testing

Figure 7A:
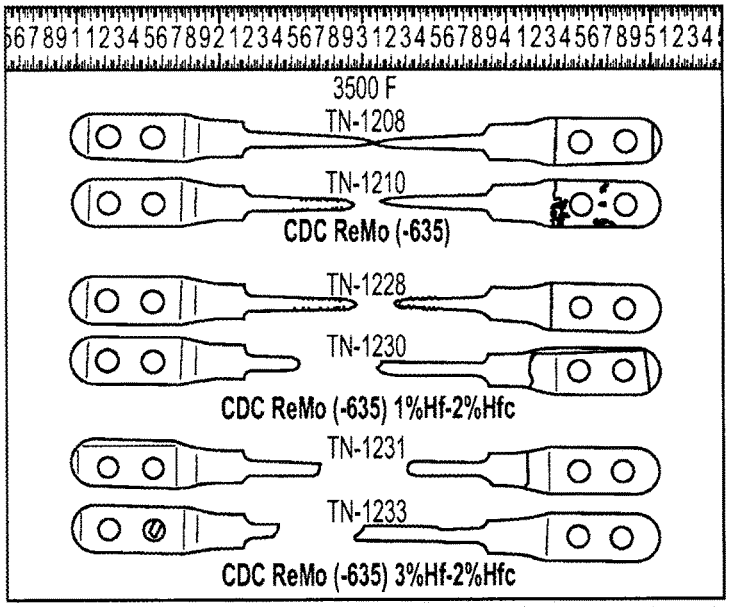
FIG. 7*a* shows CDC processed, Optimized and Successfully Tested at 3500 deg. F. of Mo/Re Alloys after Mechanical Testing Indicating Ductile Fractures.
Figure 7B:
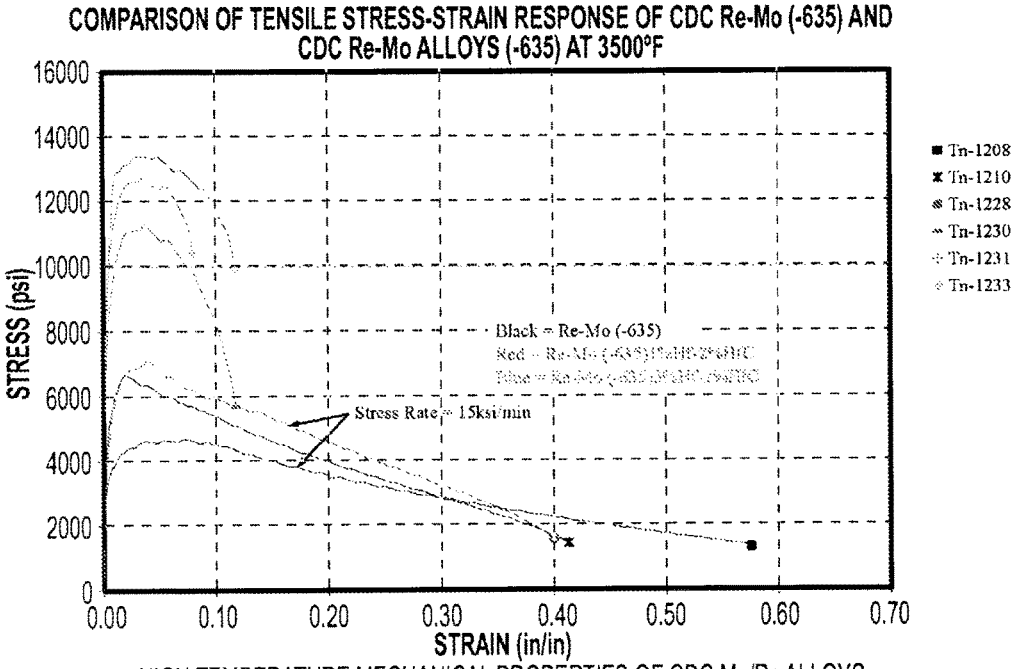
FIG. 7*b* graphs High Temperature Mechanical Properties of CDC Mo/Re Alloys.
Figure 7C:
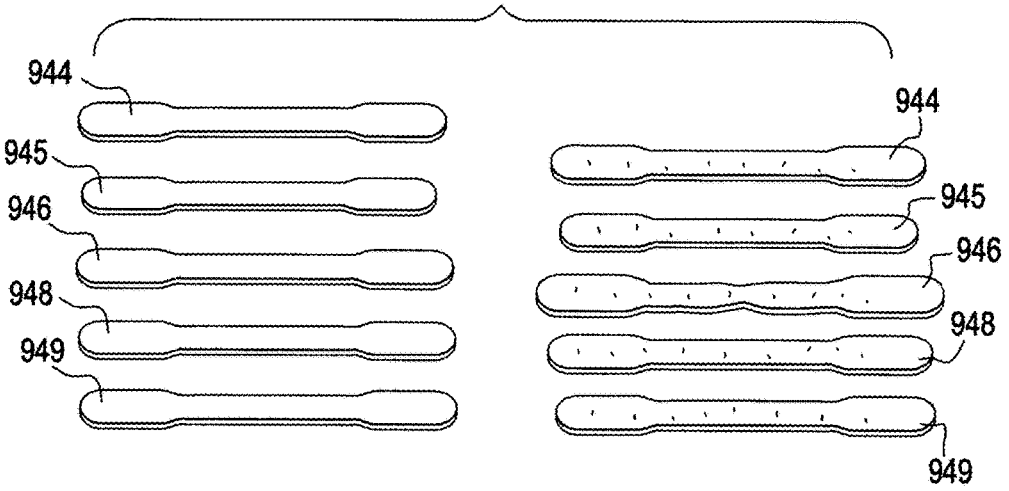
FIG. 7*c* shows Sintered Tensile Dogbone Samples Before and After Mechanical Testing at Room Temperature.

Two identical tensile dogbone samples of the most promising alloy compositions with a total of 22 samples (Tables 6 and 7) for high temperature mechanical strength evaluation. The sintering of these samples was also completed successfully in hydrogen environment at 2300 deg C. for about 4 hours. FIGS. 7*a* and 7*b* provide the major findings of the enhanced strength properties of composite material of Mo—Re base alloy with increasing Hf concentration at a given fixed level of 2% HfC. Such increased strengthening is a major breakthrough to improve the high temperature mechanical properties applications of the CDC processed composites for advanced rocket nozzle thrust component applications. While it is important to optimize the composition, such innovation in both high pressure CDC powder compaction and composite material development for the Mo—Re base alloy as well as Re and W-25 Re systems with Hf and HfC is unique as claimed.

Traditionally processed P/M parts with materials such as Rhenium based alloys (Rhenium has HCP crystal structure) using extensive mechanical (extrusion, swaging or rolling) and thermo-mechanical steps are known to have great deal of texturing effects which affect the cracking tendency behavior during fabrication. Hence, it is desirable to minimize such texturing effects by intelligent processing. This CDC high pressure consolidation manufacturing together with the optimal composite material composition leads to a simplified two-step process of high pressure near net shape processing.

Microstructural Results

Figure 15:
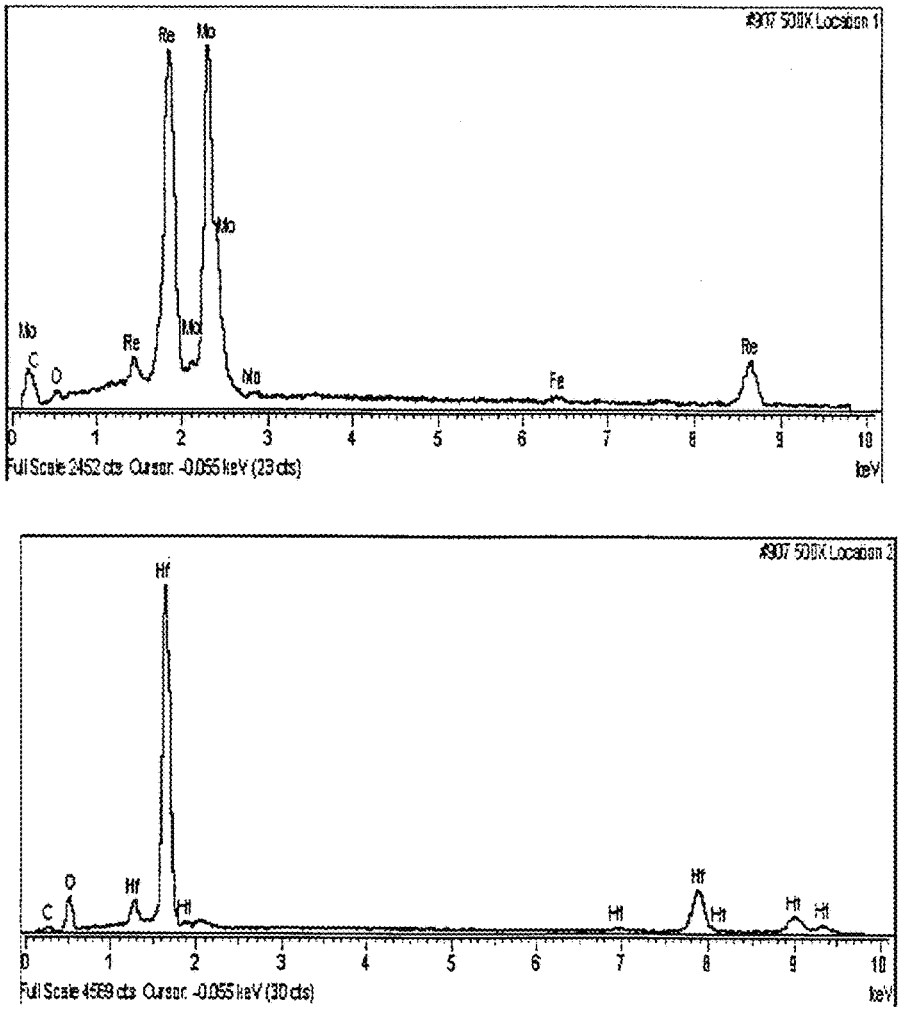
FIG. 15 is Sample #907 XRay EDS of Matrix and Hf-Rich Areas of Sintered CDC Mo—Re-1Hf Microstructure.
Figure 16:
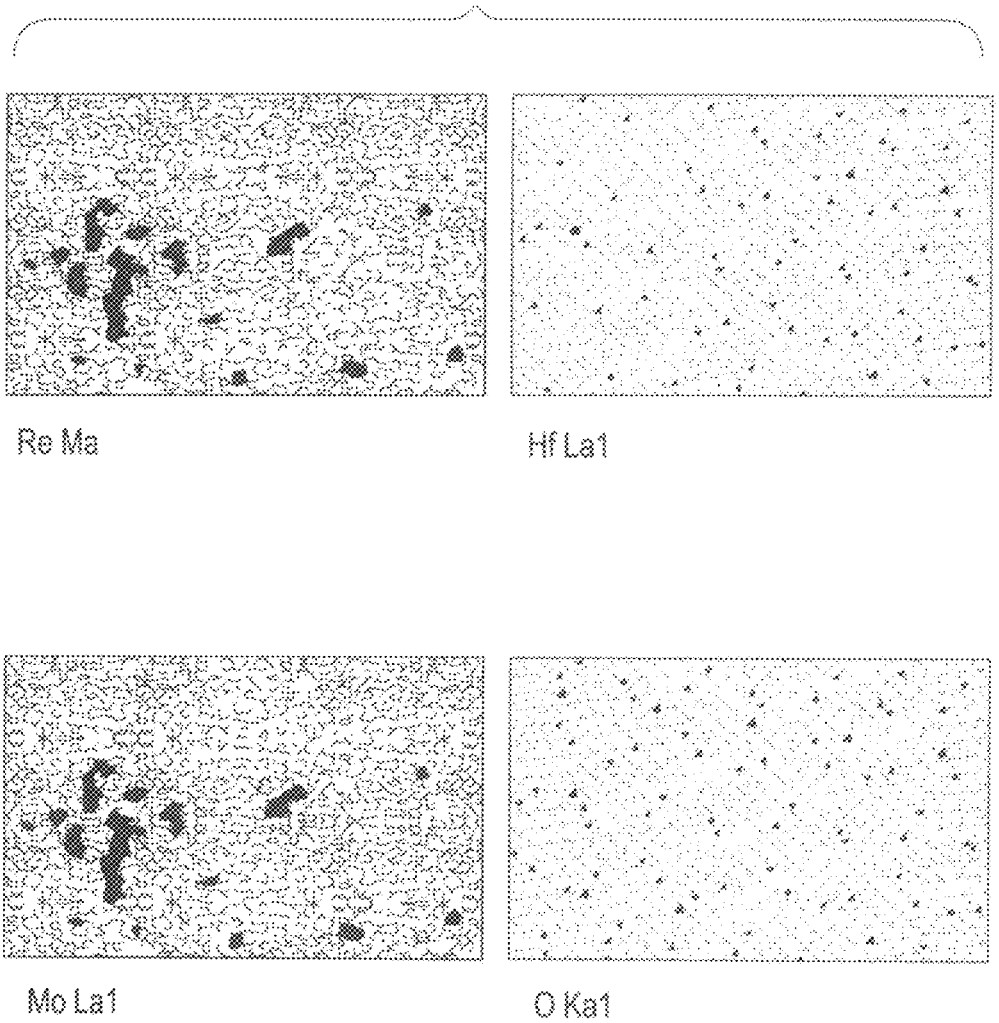
FIG. 16 is Sample #907 XRay EDS Dot Map of Re, Hf, Mo and O in Sintered CDC Mo—Re-1Hf Microstructure.
Figure 18:
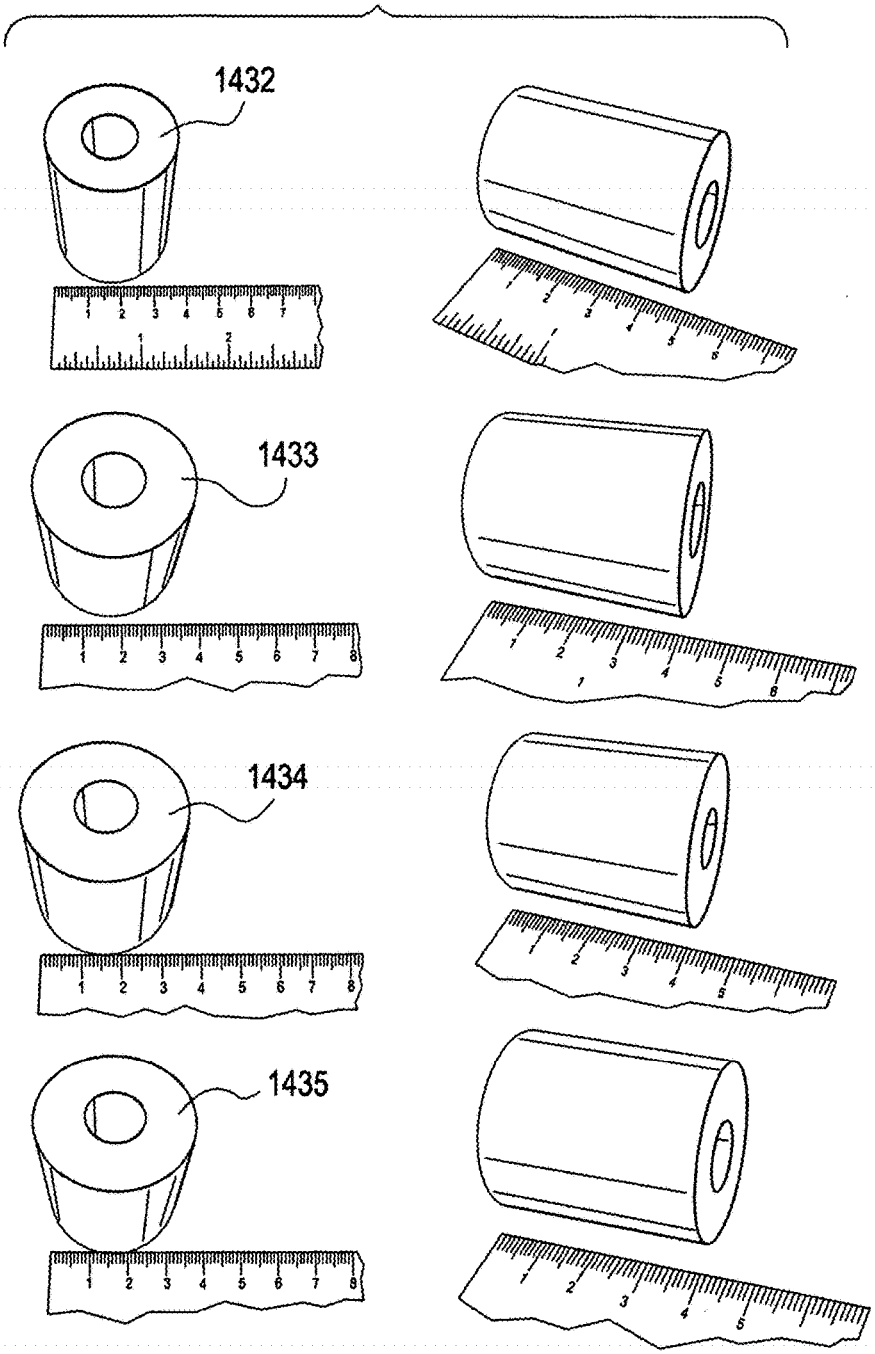
FIG. 18 shows CDC Near-Net Shape Rocket Nozzle System Parts.

The microstructural studies (e.g., FIGS. 10-11, 12-14) demonstrate the polycrystalline nature of grains, distribution of alloying elements such as Hf and microstructural characteristics for both CDC Processed Mo/Re matrix and composite materials with Hf and HfC (FIGS. 15-17). FIGS. 15-17 evidence the Hf enrichment in CDC Mo—Re composites with Hf and HfC in X-ray Energy Dispersive Spectroscopy (EDS) and X-Ray EDS Elemental Dot Maps indicating reasonable incorporation after CDC compaction and sintering. The microscopy (e.g., FIGS. 10 and 11) of select samples show that the average grain size of the optimally, sintered Mo—Re samples was much finer in hydrogen sintered samples than those sintered in vacuum. (Table 15)

High Pressure Consolidation of Fine Re/Mo—Re Powders:

The unique advantages of high pressure compaction at 150 tsi to fabricate production run tensile dogbone samples of a variety of powder sizes (e.g., −200 mesh, <74 microns and −635 mesh, ~<20 microns) are apparent. It is important to highlight that the finer grit size (e.g., −635 mesh) powders of Re or Mo/Re are known to be difficult to be pressed by traditional P/M methods at compaction pressures <50-55 tsi. Such composites included the improved strength properties of 50%-50% mix. The technical basis for such approach is beneficial to produce CDC high density metal matrix composites in near net shape with finer carbide distribution to further improve the mechanical properties.

Summary of Conclusions

Rhenium based refractory composites, various Re Mo and W based refractory composites (e.g., 52.5 Mo/47.5 Re Mo-41 Re, W-25 Re, Re by weight %) alloys with and without Hf and HfC have been compacted in various geometrical shapes using high pressure CDC compaction at 150 tsi and sintered successfully for high temperature mechanical property enhancement and optimization.

The geometries fabricated include 0.5 inch dia cylindrical disks (FIGS. 12, 24), 3.5 inch long flat tensile dogbones (FIGS. 12-14 and FIGS. 17-29), 0.5 inch OD circular ring and small scale near net shape components.

Crack-free and well-bonded near net shape circular rings of various Re/Mo alloys with Hf and HfC have been fabricated at high pressures as well.

CDC processed materials @150 tsi have showed higher green (e.g., 75 to 82% TD) and sintered densities (e.g., 93 to 97%), improved mechanical strength (up to 135 ksi)/ductility (up to 30%)/hardness (315 VHN) properties, polycrystalline microstructures, fine surface finishes, less shrinkage and near net shaping fabricability.

The sintering response results are better in terms of less shrinkage than traditional P/M parts and comparable to wrought annealed materials.

The sintered microstructures and microchemistry after 2100 deg C.; 4 hrs revealed polycrystallinity, distribution of Hf and other alloying elements, variety of fine grain sizes (<64 microns average size), and relatively finer surface finishes. Such fine grained microstructures developed by suitably and optimally controlling the processing conditions without much grain growth are unique characteristics of high pressure CDC compaction when the refractory composite materials are compacted at 150 tsi which has not been reported previously.

Effects of adding Hafnium and HfC in Mo/Re alloys were found to significantly improve the high temperature strength properties up to at least 3500 deg F., indicating the significance of further Mo—Re—X—Y (X=Hf; Y=HfC) alloy development using CDC high pressure compaction technology. Such improvement using CDC high pressures (e.g., 150 tsi) has not been reported for the developed innovative refractory composite materials using any conventional powder metallurgy technology which is usually limited to <50-55 tsi compaction pressures.

Sintering response at higher temperatures (e.g., 2300 deg C.) increases sintered densities and the mechanical properties as well.

CDC high pressure compacted and sintered Re/Mo composite materials alloys have showed significant necking indicating the desirable ductility behavior before fracture at room temperatures (FIG. 7*c*) as well as at high temperatures (e.g., 3500 deg F. as shown in FIG. 7*a*).

Alloys with 1% Hf and 2% HfC have showed reasonable strength and ductility properties at room temperature. (Tables 14-16. Table 18)

Controlled Sintering of CDC samples in Hydrogen plays a key role as well in influencing the mechanical properties of Re and Re—Mo alloys with Hf and HfC.

Near net shape parts have been successfully compacted using both coarse (<70 micron size) and fine (<20 microns) mechanically blended powders (52.5 Mo/47.5 Re) and using 59% Mo-41% Re alloy (<70 micron size powders) obtained again from Rhenium Alloys at varying CDC pressures up to 150 tsi. The highest density of 82.22% is very encouraging simulating the tensile dogbone densities at 150 tsi. (Table 16 and FIG. 18) in near net shape complex parts of various refractory materials.

In summary, the Mo/Re (52.5Mo-47.5Re) composite alloys with and without Hafnium (Hf) and Hafnium Carbides (HfC) in varying compositions and in the optimum composition can be compacted successfully at 150 tsi using a 300 ton CDC press with much higher green and sintered densities, crack-free parts during CDC pressing at high pressures and unique faster CDC loading cycle of milliseconds, comparable room temperature and high temperature (up to 3500 deg F.) mechanical properties equivalent to those of traditional annealed wrought materials, near net shaping ability to fabricate different geometries (disk, ring, dogbones), fine surface finish/quality, process flexibility to fabricate novel powder alloys, controllable grain sizes, microstructures and microchemistry and significant cost effectiveness in both materials wastage minimization and manufacturing. This unique technology can manufacture high temperature components economically.

With high pressure CDC compaction press, many of the challenges with other manufacturing methods can be overcome. The powder handling and compaction with both micron as well as nano-sized refractory Mo/Re composite alloys and ceramic powders can be carried out successfully at high pressures to improve the densification, for example. Also, the CDC process can be done in controlled inert conditions (e.g., using glove box and inert gas supply in the die/punch setup). This manufacturing is also amenable for functional gradient structures of several layers of differing materials and composites for multi-functional use. Such manufacturing strategy using CDC process is anticipated to be a competitive alternative than the existing traditional rapid prototyping fabrication methods, conventional P/M and wrought methods and conventional coating processes.

In light of several other manufacturing methods as discussed above, the high pressure CDC compaction process is expected to have several unique cost-effective manufacturing advantages of high pressure densification, ability to press coarse, fine and even nano powders, rapid development for advanced composite materials of unique compositions tailoring to the material property and functional property needs for high temperature applications, near net shaping ability, lot less or no scrap metal % and improved mechanical and microstructural attributes for developing advanced propulsion thruster system components.

Current Status of CDC Mo—Re Based Composites, Processing and Near Net Shape Components

- Several additional Mechanical Test Samples have been compacted and sintered by CDC Processing at 150 tsi.
- Sintering of Additional Mechanical Test Samples of the following Alloys
  - Finer powder alloys with 52.5 Mo-47.5 Re alloys; Mo/Re with 1% Hf and 2 HfC and Mo/Re with 3% Hf and 2% HfC Alloys:
  - Mo/Re with 1% Hf H2 and 2 HfC
  - Mo/Re with 3% HfH2 and 2 HfC
  - Processing of CDC green samples
- CDC Processed Fabrication and Processing
- Select made of −200 mesh and −635 mesh have been fabricated
- Mechanically Blended Powder alloys of 59 Mo-41 Re (−635 mesh size; <20 micron sized powders)
- CDC Tensile Dogbone Fabrication and Processing of 59 Mo-41 Re alloys
- Discussion for Analysis of Powders Used and CDC Processed and CDC processed tensile Dogbone samples for additional mechanical property testing at 3500 deg F.

Figure 19C:
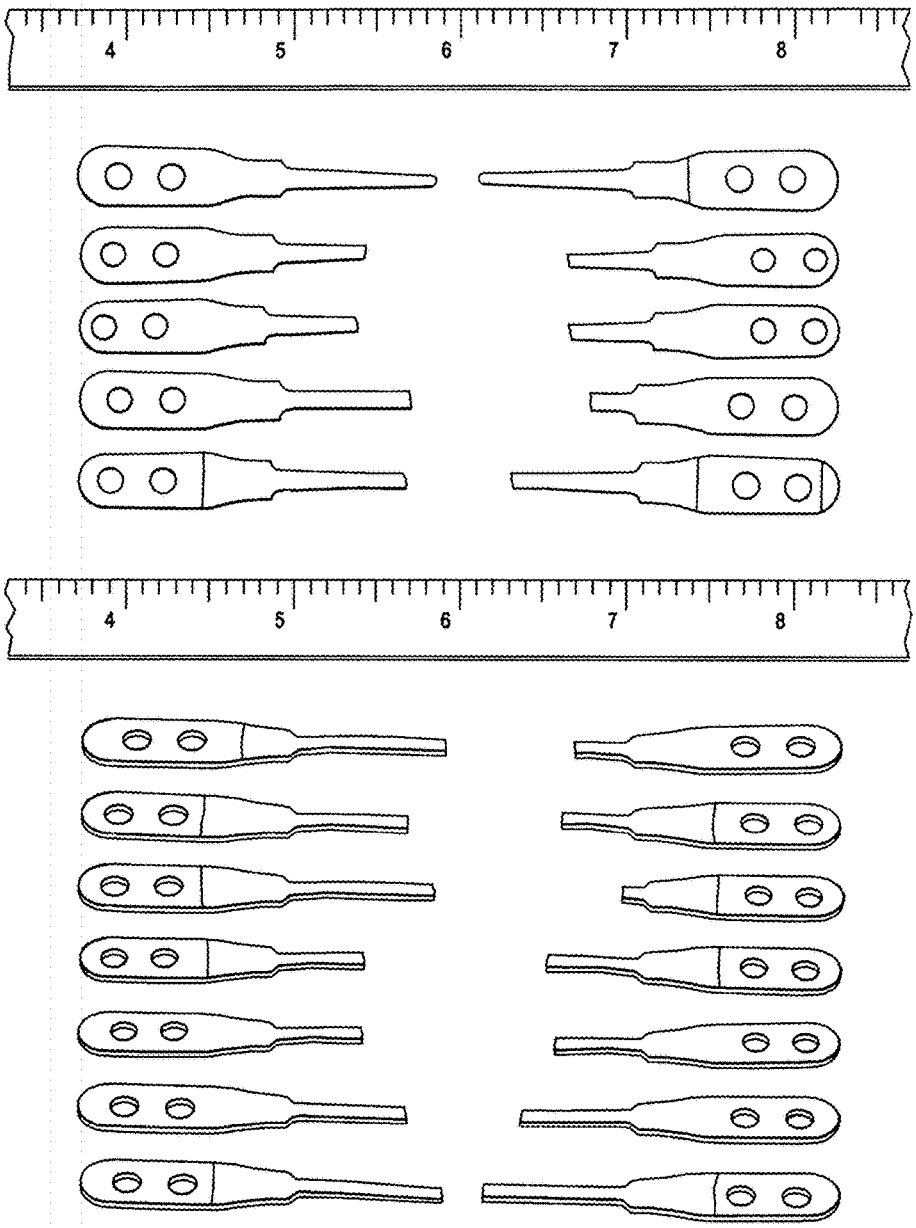
Figure 20F:
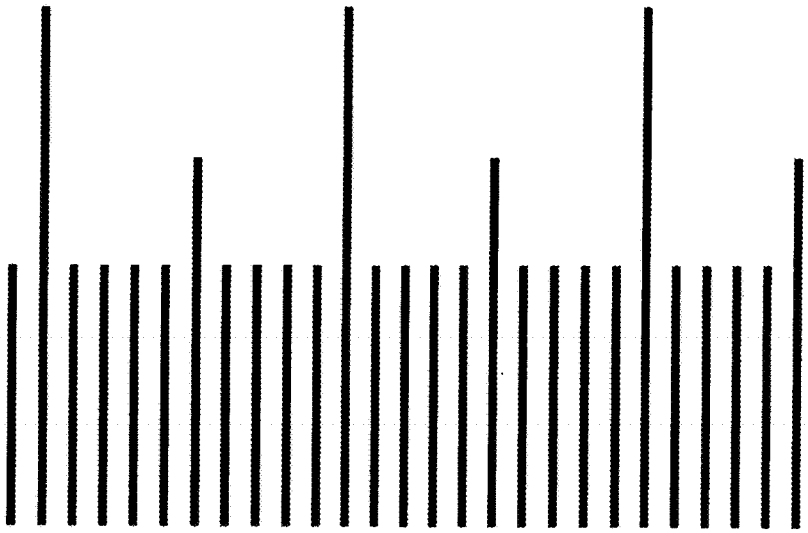

FIG. 19 is a diagram showing the combustion driven compaction process. A chamber, powder, piston or ram, and gas supply are provided 100, 102, 104, 106. A die may also be provided 108. The chamber is filled with a mixture of natural gas and air 110. In one embodiment, the piston or ram is pressed against the powder 112 as the chamber is being filled, pre-compressing and removing entrapped air from the powder. The gas supply is closed 114 and the gas is combusted 116, which causes the pressure in the chamber to rise and exert force on the piston or ram. The powder is then compressed into its intended shape 118. The high pressure and temperature exhaust gases produced by the combustion may be used for other press operations 120. In one embodiment, the compressed powder is sintered 122.

Referring to FIGS. 19 *a-c* and 20 *a-f*, Re, Mo-41Re, W-25 Re and their composites with Hf, HfC, Ta, W, Mo of select compositions have been successfully compacted in various simple (disks, tensile dogbones) to complex geometries (e.g., multi-layered form) at 150 tsi and optimally and thermally sintered.

The densification attributes (Table 19) after optimal sintering are in upper 90s indicating the unique advantages of high pressure compacted samples and their response for post-compaction thermal processing.

The CDC processed materials (FIG. 20*a*-20*f*) have exhibited (Table 21) fairly fine grained microstructures (e.g., average grain size of 22.5 microns in Rhenium, 31.8 microns in W-25Re, and 63.5 microns in Mo-41 Re) when suitably sintered. Mo-41 Re samples have showed relatively larger grain size as compared to Re, W-25Re, Re-5Ta-0.5 Hf-2

HfC and Re samples under identical sintering conditions. Overall, the CDC compacted and sintered microstructures were finer than possible with conventionally processed materials, depending on the composition of refractory material combinations.

Microchemistry results were found to confirm the composite materials (e.g., Re with Ta, Hf and C being retained in the microstructures).

Out of all the alloys, Rhenium has exhibited the maximum and significant strengthening effect (Rc 34 to 55) using composite alloying. Mo-41Re and W-25 Re materials also responded to some improvement in strengthening. (Table 20)

The mechanical strengthening attributes at room temperature (Table 20) of refractory and composite alloying (especially with Hf and HfC) have been provided in the following Table.

The additional high temperature property results of CDC compacted (at 150 tsi) and sintered Mo-41Re, W-25 Re and Rhenium together with previously tested 52.5 Mo-47.5 Re materials and their composites tested at 3500 deg F. are presented. Tensile specimen densities of the CDC compacted and sintered samples were measured using Archimedes technique in alcohol (Table 22).

A comparison plot of all the specimens tested shows the differences in material responses from alloy to alloy.

- The appearance of the W-25% Re stress-strain curve is similar to Mo-41% Re in that both materials exhibit a serrated or sawtooth stress-strain response after the maximum load was observed. It should be noted that the sawtooth appearance for Mo-41% Re is suppressed due to the stress scale (see the Mo—Re comparison chart for sawtooth appearance).
- The W-25% Re and Mo-41% Re specimens have high elongations compared to the pure rhenium specimens and differences can be seen in the post-test group photo of the specimens.

The pure rhenium specimens were made with various powder sizes (−635 and −325 mesh) and various powder manufacturers.

- The data are similar to other rhenium materials, such as cold-rolled rhenium and HIP'd rhenium.
- The Mo-41% Re specimen shows a higher strength compared to the Mo-47.5% Re data from February 2007. The material response of Mo-41% Re is consistent with Mo-47.5% Re The tensile samples revealed varying mode of fracture from necking (mostly on Mo—Re based alloys) to less necking modes in Rhenium samples.

While the invention has been described with reference to specific embodiments, modifications and variations of the invention may be constructed without departing from the scope of the invention.

TABLE 1

Properties of Refractory Materials and Ceramics for Composites

| Material | | | Density (g/cc) | MP (° C.) | CTE (ppm/° C.) | E (GPa) | Other |
|---|---|---|---|---|---|---|---|
| A) | Refractory metals | Nb | 8.4 | 2470 | 9 | 100 | Ductile |
| | | Ta | 16.6 | 3000 | 8 | 190 | Ductile |
| | | Mo | 10.2 | 2620 | 8 | 320 | |
| | | W | 19.3 | 3400 | 7 | 420 | |
| | | Re | 22. | 3180 | 7 | 480 | Expensive |
| B) | Borides | $HftB_2$ | 11.2 | 3250 | 6-7 | | |
| | | $NbB_2$ | 7.2 | 2900 | 9 | | Decomposes |
| | | $TaB_2$ | 12.6 | 3000 | 6-7 | 260 | |
| | | $TiB_2$ | 4.5 | 2900 | 7 | 500 | |
| | | $WB_2$ | 2900 | | | | |
| | | $ZrB_2$ | 6.1 | 3000 | 8 | 450 | |
| C) | Carbides | HfC | 12.7 | 3880 | 7 | 430 | |
| | | SiC | 3.2 | 2600 | 6 | 450 | Sublimes |
| | | NbC | 7.8 | 3700 | 7 | 450 | |
| | | TaC | 14.5 | 3700 | 9 | 450 | |
| | | TiC | 4.9 | 3140 | 9 | 450 | |
| | | ZrC | 6.7 | 3450 | 8 | 420 | |
| D) | Nitrides | BN | 2.2 | 3000 | High crystalline anisotropy | | Sublimes |
| | | HfN | 13.9 | 3300 | 7 | | |
| | | TaN | 14.1 | 3200 | 5 | | |
| | | ThN | 11.6 | 2800 | | | α-emitter |
| | | TiN | 5.4 | 2950 | 10 | 260 | |
| | | ZrN | 7.4 | 2980 | 8 | | |
| E) | Oxides | Be0 | 3. | 2500 | 8 | 400 | Toxic |
| | | $HfO_2$ | 9.7 | 2750 | 11 | | |
| | | MgO | 3.6 | 2800 | 16 | 350 | Hydrates |
| | | $ThO_2$ | 9.8 | 3200 | 11 | 240 | α-emitter |
| | | $ZrO_2$ | 5.7 | 2715 | 12 | 230 | |

*MP = melting point, CTE = coefficient of thermal expansion, and E = Young's Modulus

TABLE 2

Thermophysical & Mechanical Properties of High Temperature Ceramics [5, 8, 9, 17, 37-38-42]

| Ceramic Material | Melt Temp. (deg C.) | Density (g/cc) | Thermal Exp. Coeff @20 deg C. ($10^{-6}$/deg) | Thermal Exp Coeff @1000 deg C. ($10^{-4}$/deg) | Thermal Conductivity (W/m/K) | Hardness of the Material (GPa) | Other Material Properties: E = Elastic Modulus And Crystal Structure |
|---|---|---|---|---|---|---|---|
| Beta-SiC | 2545 | 3.214 | 3.3 | 5.8 | 43-145 | 24.5-28.2 | E = 475 GPa; Flexural. Strength: 400-490 MPa @ 700-1200 deg C.; FCC |
| $B_4C$ | 2450 | 2.52 | 4.3 | | 20-35 | 48 | E = 290-450 GPa; Flexural Strength: 320-430 GPa |
| HfC | 3928 | 12.67 | 4.9 | 7.2 | 20 | 26.1 | E = 350-510 GPa; FCC |
| TaC | 3950 | 14.50 | 5.6 | 7.3 | 22.1 | 16.7 | E = 285-560 GPa; Trans. Rupture Strength TRS = 350- |

TABLE 2-continued

Thermophysical & Mechanical Properties of High Temperature Ceramics [5, 8, 9, 17, 37-38-42]

| Ceramic Material | Melt Temp. (deg C.) | Density (g/cc) | Thermal Exp. Coeff @20 deg C. ($10^{-6}$/deg) | Thermal Exp Coeff @1000 deg C. ($10^{-4}$/deg) | Thermal Conductivity (W/m/K) | Hardness of the Material (GPa) | Other Material Properties: E = Elastic Modulus And Crystal Structure |
|---|---|---|---|---|---|---|---|
| | | | | | | | 400 MPa; Cubic |
| ZrC | 3420 | 6.56 | 4.0 | 8.3 | 40 | 30.55 | E = 386 GPa; FCC |
| TiC | 3140 | 4.92 | 6.4 | 8.9 | 50 | 31.20 | E = 448 GPa; FCC |

TABLE 3

Sintered CDC Mo/Re Ring Sample Properties (Sintered at 2300 deg C.; 4 hrs in Hydrogen) [44]

| Sample #: | Description: | Mass: grams | ID (in): | OD (in): | Height (in): | Density (g/cc) |
|---|---|---|---|---|---|---|
| 1023 | Re/Mo (−200) | 5.1878 | 0.3045 | 0.4780 | 0.2300 | 12.9086 |
| 1024 | Re/Mo (−200) Re/Mo (−635) | 5.1978 | 0.3055 | 0.4790 | 0.2305 | 12.8725 |
| | 50% | 5.1168 | 0.3070 | 0.4820 | 0.2225 | 12.9408 |
| 1025 | Re/Mo (−635) | | | | | |
| 1026 | Re/Mo (−200/−635) 1% Hf | 5.2001 | 0.3055 | 0.4790 | 0.2320 | 12.7949 |
| | 2% Hfr | | | | | |
| 1027 | Re/Mo (−200/−635) 5% Hf | 5.2199 | 0.3060 | 0.4815 | 0.2335 | 12.5677 |
| | 2% HfC | 5.2345 | 0.3055 | 0.4805 | 0.2280 | 12.9684 |
| 1028 | Re/Mo (−635) 1% Hf 2% HfC | 5.4333 | 0.3080 | 0.4840 | 0.2425 | 12.4888 |
| 1029 | Re/Mo (−635) 5% Hf 2% HfC | 5.1606 | 0.3030 | 0.4760 | 0.2315 | 12.8521 |
| 1030 | Re/Mo (−200) 1% Hf | | | | | |

Table 4a-k. CDC Pressure, Physical and Geometrical Properties of CDC Green Parts [41]

TABLE 4a

Rhenium & Molybdenum in ½" Cylinder Die

| Sample #: | Description: | CDC Pressure (tsi) | Green Density (g/cc) | % of Theoretical Density | OD (in) | Avg. Thick-ness (in) |
|---|---|---|---|---|---|---|
| 876 | Re/Mo | 144.5 | 11.3512 | 81.11 | 0.5030 | 0.1090 |
| 877 | Re/Mo | 129.7 | 11.2082 | 80.09 | 0.5030 | 0.1105 |
| 878 | Re/Mo | 153.3 | 11.4478 | 81.80 | 0.5030 | 0.1080 |
| 879 | Re/Mo | 153.7 | 11.4620 | 81.90 | 0.5030 | 0.1080 |
| 880 | Re/Mo | 148.9 | 11.4364 | 81.72 | 0.5030 | 0.1080 |
| 881 | Re/Mo | 153.1 | 11.4791 | 82.02 | 0.5030 | 0.1080 |

Die Wall Lubrication: Zinc Stearate
Powder Specifications: Rhenium Alloys; Re, Mo (47.5%), Lot# R-1490
Theoretical Density: 13.9951 g/cc TABLE 4b Rhenium in ½" Cylinder Die

| Sample #: | Description: | CDC Pressure (tsi) | Green Density (g/cc) | % of Theoretical Density | OD (in) | Avg. Thick-ness (in) |
|---|---|---|---|---|---|---|
| 882 | Re | 153.0 | 15.9155 | 75.72 | 0.5025 | 0.1062 |
| 883 | Re | 153.7 | 15.9600 | 75.93 | 0.5025 | 0.1060 |
| 884 | Re | 154.5 | 15.9571 | 75.91 | 0.5025 | 0.1060 |
| 885 | Re | 155.4 | 15.9484 | 75.87 | 0.5025 | 0.1060 |
| 886 | Re | 152.4 | 15.9213 | 75.74 | 0.5025 | 0.1062 |
| 887 | Re | 145.7 | 15.7764 | 75.05 | 0.5025 | 0.1070 |

TABLE 4b-continued

Rhenium in ½" Cylinder Die

| Sample #: | Description: | CDC Pressure (tsi) | Green Density (g/cc) | % of Theoretical Density | OD (in) | Avg. Thick-ness (in) |
|---|---|---|---|---|---|---|

Die Wall Lubrication: Zinc Stearate
Powder Specifications: Rhenium Alloys; Re, −200 hg mesh, Lot# R-1460
Theoretical Density: 21.02 g/cc TABLE 4c Re/Mo 12.5% wt HfC in ½" cylinder die

| Sample #: | Description: | CDC Pres-sure (tsi) | Green Density (g/cc) | % of Theo-retical Density | OD (in) | Avg. Thick-ness (in) |
|---|---|---|---|---|---|---|
| 894 | Re/Mo/HfC 12.5% | 158.6 | 11.0058 | 79.67 | 0.5035 | 0.1110 |
| 895 | Re/Mo/HfC 12.5% | 154.3 | 11.0311 | 79.85 | 0.5033 | 0.1110 |
| 896 | Re/Mo/HfC 12.5% | 154.9 | 11.0300 | 79.84 | 0.5032 | 0.1110 |
| 897 | Re/Mo/HfC 12.5% | 157.9 | 11.0650 | 80.10 | 0.5033 | 0.1103 |
| 898 | Re/Mo/HfC 12.5% | 155.9 | 11.0194 | 79.77 | 0.5030 | 0.1110 |
| 899 | Re/Mo/HfC 12.5% | 153.7 | 10.9807 | 79.49 | 0.5030 | 0.1110 |

Die Wall Lubrication: Zinc Stearate
Powder Specifications: Rhenium Alloys; Re, Mo (47.5%), Lot# R-1490;
Cerac; Hafnium Carbide Hit, typically 99.5% pure, −325 mesh, Lot# 607913-1A
Theoretical Density: 13.8145 g/cc TABLE 4d Re 1% wt Hf in ½" cylinder die

| Sample #: | Description: | CDC Pressure (tsi) | Green Density (g/cc) | % of Theoretical Density | OD (in) | Avg. Thickness (in) |
|---|---|---|---|---|---|---|
| 900 | Re/Hf 1% | 154.3 | 15.8051 | 75.63 | 0.5025 | 0.1070 |
| 901 | Re/Hf 1% | 155.7 | 15.8396 | 75.79 | 0.5025 | 0.1070 |

Die Wall Lubrication: Zinc Stearate
Powder Specifications: Rhenium Alloys; Re, −200 hg mesh, Lot# R-1460;
Alfa Aesar; Hafnium pwdr, −325 mesh 99.6% (metal basis excluding Zr) Zr nominal 2-3.5%, Lot# H28M16
Theoretical Density: 20.8989 g/cc TABLE 4e Re in ½" cylinder die

| Sample #: | Description: | CDC Pressure (tsi) | Green Density (g/cc) | % of Theoretical Density | OD (in) | Avg. Thickness (in) |
|---|---|---|---|---|---|---|
| 902 | Re | 151.1 | 15.8109 | 75.22 | 0.5025 | 0.1070 |
| 903 | Re | 144.4 | 15.7431 | 74.90 | 0.5025 | 0.1075 |

Die Wall Lubrication: Zinc Stearate
Powder Specifications: Rhenium Alloys; Re, −200 hg mesh, Lot# R-1460;
Theoretical Density: 21.02 g/cc TABLE 4f Re/Mo in ½" cylinder die

| Sample #: | Description: | CDC Pressure (tsi) | Green Density (g/cc) | % of Theoretical Density | OD (in) | Avg. Thickness (in) |
|---|---|---|---|---|---|---|
| 904 | Re/Mo | 152.9 | 11.3878 | 81.37 | 0.5030 | 0.1090 |
| 905 | Re/Mo | 156.2 | 11.3935 | 81.41 | 0.5030 | 0.1090 |

Die Wall Lubricaton: Zinc Stearate
Powder Specifications: Rhenium Alloys; Re, Mo (47.5%), Lot# R-1490
Theoretical Density: 13.9951 g/cc TABLE 4g Re/Mo 1% wt Hf in ½" cylinder die

| Sample #: | Description: | CDC Pressure (tsi) | Green Density (g/cc) | % of Theoretical Density | OD (in) | Avg. Thickness (in) |
|---|---|---|---|---|---|---|
| 906 | Re/Mo/Hf 1% | 152.6 | 11.3354 | 81.04 | 0.5030 | 0.1088 |
| 907 | Re/Mo/Hf 1% | 151.9 | 11.3060 | 80.83 | 0.5030 | 0.1093 |

Die Wall Lubrication: Zinc Stearate
Powder Specifications: Rhenium Alloys; Re, Mo (47.5%), Lot# R-1490;
Alfa Aesar; Hafnium pwdr, −325 mesh 99.6% (metal basis excluding Zr) Zr nominal 2-3.5%, Lot# H28M16
Theoretical Density: 13.9879 g/cc TABLE 4h Re/Mo tensile bar

| Sample #: | Description: | CDC Pressure (tsi) | Green Density (g/cc) | % of Theoretical Density | Length (in) | Avg. Thickness (in) |
|---|---|---|---|---|---|---|
| 908 | Re/Mo | 134.0 | 11.4738 | 81.98 | | 0.1380 |

TABLE 4h-continued

Re/Mo tensile bar

| Sample #: | Description: | CDC Pressure (tsi) | Green Density (g/cc) | % of Theoretical Density | Length (in) | Avg. Thickness (in) |
|---|---|---|---|---|---|---|
| 909 | Re/Mo | 130.4 | 11.5246 | 82.35 | 3.542 | 0.1428 |

Die Wall Lubrication: Zinc Stearate
Powder Specifications: Rhenium Alloys; Re, Mo (47.5%), Lot# R-1490
Theoretical Density: 13.9951 g/cc TABLE 4i Re tensile bar

| Sample #: | Description: | CDC Pressure (tsi) | Green Density (g/cc) | % of Theoretical Density | Length (in) | Avg. Thickness (in) |
|---|---|---|---|---|---|---|
| 910 | Re | 133.1 | 15.9438 | 75.85 | 3.54 | 0.1452 |
| 911 | Re | 130.3 | 15.8535 | 75.42 | 3.54 | 0.1462 |

Die Wall Lubrication: Zinc Stearate
Powder Specifications: Rhenium Alloys; Re, −200 hg mesh, Lot# R-1460
Theoretical Density: 21.02 g/cc TABLE 4j Re/Mo 1% wt Hf tensile bar

| Sample #: | Description: | CDC Pressure (tsi) | Green Density (g/cc) | % of Theoretical Density | Length (in) | Avg. Thickness (in) |
|---|---|---|---|---|---|---|
| 912 | Re/Mo/Hf 1% | 127.8 | 11.7157 | 83.76 | 3.543 | 0.1405 |
| 913 | Re/Mo/Hf 1% | 132.3 | 11.5023 | 82.23 | 3.542 | 0.1430 |

Die Wall Lubrication: Zinc Stearate
Powder Specifications: Rhenium Alloys; Re, Mo (47.5%), Lot# R-1490;
Alfa Aesar; Hafnium pwdr, −325 mesh 99.6% (metal basis excluding Zr) Zr nominal 2-3.5%, Lot# H28M16
Theoretical Density: 13.9879 g/cc TABLE 4k Re 1% wt Hf tensile bar

| Sample #: | Description: | CDC Pressure (tsi) | Green Density (g/cc) | % of Theoretical Density | Length (in) | Avg. Thickness (in) |
|---|---|---|---|---|---|---|
| 914 | Re/Hf 1% | 136.5 | 15.9798 | 76.46 | 3.54 | 0.1450 |
| 915 | Re/Hf 1% | 136.0 | 15.9668 | 76.40 | 3.54 | 0.1451 |

Die Wall Lubrication: Zinc Stearate
Powder Specifications: Rhenium Alloys; Re, −200 hg mesh, Lot# R-1460;
Alfa Aesar; Hafnium pwdr, −325 mesh 99.6% (metal basis excluding Zr) Zr nominal 2-3.5%, Lot# H28M16
Theoretical Density: 20.8989 g/cc TABLE 5a Sintered CDC Disk Results after 4 hr @ 2000 deg F. (1093 deg C.), 16 hrs @ 3250 deg F. (1787 deg C.) (Sintering Environment: Hydrogen) [41]

| Sample ID | Weight (gms) | Dia (inches) | Thickness (inches) | Density (g/cc) |
|---|---|---|---|---|
| 878 (Mo/Re) | 4.0177 | 0.490 | 0.105 | 12.38 |
| 879 (Mo/Re) | 4.0231 | 0.490 | 0.105 | 12.40 |

TABLE 5a-continued

Sintered CDC Disk Results after 4 hr @ 2000 deg F. (1093 deg C.), 16 hrs @ 3250 deg F. (1787 deg C.) (Sintering Environment: Hydrogen) [41]

| Sample ID | Weight (gms) | Dia (inches) | Thickness (inches) | Density (g/cc) |
|---|---|---|---|---|
| 884 (Re) | 5.4899 | 0.463 | 0.123 | 16.17 |
| 885 (Re) | 5.4860 | 0.462 | 0.123 | 16.23 |

TABLE 5b

Sintered CDC Disk Results after 6 hrs, 2200 deg F. (1204 deg C.), 14 hrs @ 3800 deg F. (2093 deg C.); 3 hrs @ 3900 deg F. (2148 deg C.) (Sintering Environment: Hydrogen) [41]

| Sample ID | Weight (gms) | Dia (inches) | Thickness (inches) | Density (g/cc) |
|---|---|---|---|---|
| 876 (Mo/Re) | 4.0277 | 0.480 | 0.103 | 13.17 |
| 877 (Mo/Re) | 4.0268 | 0.478 | 0.106 | 12.92 |
| 882 (Re) | 5.4902 | 0.461 | 0.098 | 20.48 |
| 883 (Re) | 5.4954 | 0.461 | 0.098 | 20.50 |

TABLE 5c-continued

Sintered CDC Disk Results after 6 hrs, 2200 deg F. (1204 deg C.), 14 hrs @ 3800 deg F. (2093 deg C.); 3 hrs @ 3900 deg F. (2148 deg C.) (Sintering Environment: Hydrogen) [41]

| Sample ID | Weight (gms) | Dia (inches) | Thickness (inches) | Density (g/cc) |
|---|---|---|---|---|
| 895 (Re/Mo/ 12.5 HfC) | 4.0211 | 0.482 | 0.109 | |
| 896 (Re!Mo/ 12.5 HfC) | 4.0217 | 0.483 | 0.109 | |
| 897 (ReMo/ 12.5 HfC) | 4.0088 | 0.483 | 0.108 | 12.36 |
| 898 (Re/Mo/ 12.5 HfC) | 4.0117 | 0.482 | 0.109 | |
| 899 (Re/Mo/ 12.5 HfC) | 3.9978 | 0.481 | 0.11 | |
| 901 (Re/Hf 1%) | 5.5113 | 0.466 | 0.099 | 19.92 |
| 907 (Re/Mo/Hf 1%) | 4.0182 | 0.481 | 0.105 | 12.86 |

TABLE 6

Properties of Green CDC Tensile Dogbone Samples [47]

| Sample #: | Description: | Mass: grams | Width, end; inches | Width, middle, smallest; inches | Width, end; inches | Length; inches | AVG thickness; inches |
|---|---|---|---|---|---|---|---|
| 958 | Re/Mo(−635) 5% Hf | 26.909 | 0.3450 | 0.2290 | 0.3450 | 3.5380 | 0.1387 |
| 959 | Re(−635) 5% Hf | 37.950 | 0.3455 | 0.2295 | 0.3450 | 3.5410 | 0.1473 |
| 960 | Re/Mo(−635) 1% Hf 2% HfC | 26.949 | 0.3450 | 0.2295 | 0.3450 | 3.5380 | 0.1402 |
| 961 | Re(−635) 1% Hf 2% HfC | 37.993 | 0.3453 | 0.2295 | 0.3493 | 3.5415 | 0.1485 |
| 962 | Re/Mo(−635) 5% Hf 2% HfC | 26.937 | 0.3450 | 0.2295 | 0.3450 | 3.5380 | 0.1403 |
| 963 | Re/Mo(−635) | 27.001 | 0.3450 | 0.2290 | 0.3450 | 3.5370 | 0.1400 |
| 964 | Re(−635) | 37.942 | 0.3450 | 0.2295 | 0.3450 | 3.5415 | 0.1462 |
| 969 | Re/Mo(−200) | 26.933 | 0.3460 | 0.2300 | 0.3460 | 3.5430 | 0.1431 |
| 970 | Re/Mo(−200) | 26.976 | 0.3456 | 0.2300 | 0.3455 | 3.5435 | 0.1439 |
| 971 | Re/Mo(−200) 1% Hf | 26.953 | 0.3455 | 0.2300 | 0.3455 | 3.5430 | 0.1438 |
| 972 | Re/Mo(−200) 1% Hf | 26.967 | 0.3460 | 0.2295 | 0.3460 | 3.5430 | 0.1425 |
| 973 | Re/Mo(−200) 1% Hf 2% HfC | 26.975 | 0.3460 | 0.2300 | 0.3460 | 3.5430 | 0.1446 |
| 974 | Re/Mo(−200) 1% Hf 2% HfC | 26.953 | 0.3460 | 0.2300 | 0.3460 | 3.5445 | 0.1442 |
| 975 | Re(−200) | 37.975 | 0.3450 | 0.2300 | 0.3450 | 3.5415 | 0.1465 |
| 976 | Re(−200) | 38.997 | 0.3450 | 0.2295 | 0.3460 | 3.5415 | 0.1463 |
| 977 | Re/Mo(−200/−635) 1% Hf 2% HfC | 26.923 | 0.3460 | 0.2300 | 0.3460 | 3.5410 | 0.1407 |
| 978 | Re/Mo(−200/−635) 1% Hf 2% HfC | 26.961 | 0.3455 | 0.2300 | 0.3455 | 3.5410 | 0.1425 |
| 979 | Re/Mo(−635) 1% Hf | 26.974 | 0.3450 | 0.2295 | 0.3450 | 3.5375 | 0.1395 |
| 980 | Re/Mo(−635) 1% Hf | 26.975 | 0.3450 | 0.2295 | 0.3450 | 3.5370 | 0.1390 |
| 981 | Re/Mo(−635) 1% Hf 2% HfC | 27.000 | 0.3460 | 0.2295 | 0.3455 | 3.5375 | 0.1407 |
| 982 | Re(−635) 1% Hf 2% HfC | 37.968 | 0.3455 | 0.2295 | 0.3455 | 3.5410 | 0.1469 |
| 987 | Re(−635) | 37.902 | 0.3450 | 0.2295 | 0.3450 | 3.5415 | 0.1446 |

TABLE 5c

Sintered CDC Disk Results after 6 hrs, 2200 deg F. (1204 deg C.), 14 hrs @ 3800 deg F. (2093 deg C.); 3 hrs @ 3900 deg F. (2148 deg C.) (Sintering Environment: Hydrogen) [41]

| Sample ID | Weight (gms) | Dia (inches) | Thickness (inches) | Density (g/cc) |
|---|---|---|---|---|
| 880 (Mo/Re) | 4.0154 | 0.481 | 0.103 | 13.09 |
| 881 (Mo/Re) | 4.0304 | 0.481 | 0.102 | 13.27 |
| 886 (Re) | 5.4875 | 0.462 | 0.098 | 20.37 |
| 887 (Re) | 5.4798 | 0.462 | 0.098 | 20.37 |

TABLE 7

Properties of Sintered CDC Tensile Dogbone Samples [47]
(Hydrogen Sintering; 2300 deg C.; 4 hours)

| Sample #: | Description: | Mass: grams | Width, end; inches | Width, middle, smallest; inches | Width, end; inches | Length; inches | AVG thickness; inches |
|---|---|---|---|---|---|---|---|
| 958 | Re/Mo(−635) 5% Hf | 26.859 | 0.3360 | 0.2230 | 0.3340 | 3.4270 | 0.1338 |
| 959 | Re(−635) 5% Hf | 37.934 | 0.3240 | 0.2170 | 0.3265 | 3.3240 | 0.1365 |
| 960 | Re/Mo(−635) 1% Hf 2% HfC | 26.841 | 0.3310 | 0.2220 | 0.3325 | 3.4030 | 0.1333 |
| 961 | Re(−635) 1% Hf 2% HfC | 37.907 | 0.3180 | 0.2100 | 0.3170 | 3.2490 | 0.1363 |
| 962 | Re/Mo(−635) 5% Hf 2% HfC | 26.846 | 0.3340 | 0.2220 | 0.3340 | 3.4180 | 0.1346 |
| 963 | Re/Mo(−635) | 26.915 | 0.3335 | 0.2200 | 0.3335 | 3.4035 | 0.1348 |
| 964 | Re(−635) | 37.873 | 0.3145 | 0.2070 | 0.3135 | 3.2100 | 0.1348 |
| 969 | Re/Mo(−200) | 26.834 | 0.3290 | 0.2185 | 0.3295 | 3.3710 | 0.1362 |
| 970 | Re/Mo(−200) | 26.776 | 0.3280 | 0.2200 | 0.3280 | 3.3700 | 0.1367 |
| 971 | Re/Mo(−200) 1% Hf | 26.886 | 0.3295 | 0.2200 | 0.3290 | 3.3725 | 0.1363 |
| 972 | Re/Mo(−200) 1% Hf | 26.921 | 0.3330 | 0.2180 | 0.3320 | 3.3785 | 0.1358 |
| 973 | Re/Mo(−200) 1% Hf 2% HfC | 26.870 | 0.3310 | 0.2185 | 0.3320 | 3.3800 | 0.1369 |
| 974 | Re/Mo(−200) 1% Hf 2% HfC | 26.869 | 0.3300 | 0.2200 | 0.3300 | 3.3790 | 0.1373 |
| 975 | Re(−200) | 37.881 | 0.3140 | 0.2085 | 0.3140 | 3.2185 | 0.1355 |
| 976 | Re(−200) | 37.910 | 0.3130 | 0.2090 | 0.3150 | 3.2180 | 0.1348 |
| 977 | Re/Mo(−200/−635) 1% Hf 2% HfC | 26.834 | 0.3340 | 0.2200 | 0.3325 | 3.4020 | 0.1347 |
| 978 | Re/Mo(−200/−635) 1% Hf 2% HfC | 26.776 | 0.3310 | 0.2220 | 0.3310 | 3.3965 | 0.1353 |
| 979 | Re/Mo(−635) 1% Hf | 26.910 | 0.3335 | 0.2220 | 0.3330 | 3.4030 | 0.1340 |
| 980 | Re/Mo(−635) 1% Hf | 26.918 | 0.3325 | 0.2210 | 0.3330 | 3.4040 | 0.1335 |
| 981 | Re/Mo(−635) 1% Hf 2% HfC | 26.906 | 0.3330 | 0.2210 | 0.3335 | 3.4040 | 0.1348 |
| 982 | Re(−635) 1% Hf 2% HfC | 37.907 | 0.3180 | 0.2120 | 0.3200 | 3.2620 | 0.1358 |
| 987 | Re(−635) | 37.837 | 0.3140 | 0.2090 | 0.3160 | 3.2220 | 0.1339 |

TABLE 8

Properties of Sintered CDC Ring Samples [47]
(Hydrogen Sintering; 2300 deg C.; 4 hours)

| Sample #: | Description: | Mass: grams | ID (in): | OD (in): | Height (in): | Density (g/cc) |
|---|---|---|---|---|---|---|
| 953 | Re/Mo | 5.323 | 0.306 | 0.476 | 0.2365 | 13.1546 |
| 954 | Re/Mo(−200) Re/Mo(−635) 50% | 5.331 | 0.305 | 0.478 | 0.236 | 12.9567 |

TABLE 9

Properties of Sintered CDC Ring Samples [47]
(Hydrogen Sintering; 2300 deg C.; 4 hours)

| Sample #: | Description: | Average shrinkage ID (%) | Average shrinkage OD (%) | Average shrinkage height (%) |
|---|---|---|---|---|
| 953 | Re/Mo | 4.97 | 5.37 | 6.52 |
| 954 | Re/Mo (−200) Re/Mo (−635) 50% | 5.28 | 4.88 | 5.98 |

TABLE 10

Properties of Sintered CDC Dogbones Fabricated Using Fine (−635 mesh) Powder (Hydrogen Sintering; 2300 deg C.; 4 hours) [47]

| Sample #: | Description: | Average shrinkage thickness (%) | Average shrinkage width (%) | Average shrinkage length (%) |
|---|---|---|---|---|
| 964 | Re (−635) | 7.75 | 8.56 | 9.36 |
| 987 | Re (−635) | 7.38 | 8.20 | 9.02 |
| 959 | Re (−635) 5% Hf | 7.35 | 6.74 | 6.13 |
| 961 | Re (−635) 1% Hf 2% HfC | 8.19 | 8.23 | 8.26 |
| 982 | Re (−635) 1% Hf 2% HfC | 7.54 | 7.71 | 7.88 |
| 963 | Re/Mo (−635) | 3.75 | 3.76 | 3.77 |
| 979 | Re/Mo (−635) 1% Hf | 3.94 | 3.87 | 3.80 |

TABLE 10-continued

Properties of Sintered CDC Dogbones Fabricated Using Fine (−635 mesh) Powder (Hydrogen Sintering; 2300 deg C.; 4 hours) [47]

| Sample #: | Description: | Average shrinkage thickness (%) | Average shrinkage width (%) | Average shrinkage length (%) |
|---|---|---|---|---|
| 980 | Re/Mo (−635) 1% Hf | 3.96 | 3.86 | 3.76 |
| 958 | Re/Mo (−635) 5% Hf | 3.55 | 3.34 | 3.14 |
| 960 | Re/Mo (−635) 1% Hf 2% HfC | 4.93 | 4.38 | 3.82 |
| 981 | Re/Mo (−635) 1% Hf 2% HfC | 4.21 | 3.99 | 3.77 |
| 962 | Re/Mo (−635) 5% Hf 2% HfC | 4.04 | 3.72 | 3.39 |

TABLE 11

Properties of Sintered Samples fabricated with coarse (−200 mesh) powders
(Hydrogen Sintering; 2300 deg C.; 4 hours) [47]

| Sample #: | Description: | Average shrinkage thickness (%) | Average shrinkage width (%) | Average shrinkage length (%) |
|---|---|---|---|---|
| 975 | Re (−200) | 7.51 | 8.31 | 9.12 |
| 976 | Re (−200) | 7.86 | 8.50 | 9.13 |
| 969 | Re/Mo (−200) | 4.83 | 4.84 | 4.85 |
| 970 | Re/Mo (−200) | 5.04 | 4.97 | 4.90 |
| 971 | Re/Mo (−200) 1% Hf | 5.21 | 5.01 | 4.81 |
| 972 | Re/Mo (−200) 1% Hf | 4.74 | 4.69 | 4.64 |
| 973 | Re/Mo (−200) 1% Hf 2% HfC | 5.30 | 4.95 | 4.60 |
| 974 | Re/Mo (−200) 1% Hf 2% HfC | 4.74 | 4.70 | 4.67 |

TABLE 12

Properties of Sintered Samples fabricated with Mixed (Both Coarse and Finer) (50% of −635 and 50% of −200 mesh) powders [47] (Hydrogen Sintering; 2300 deg C.; 4 hours)

| Sample #: | Description: | Average shrinkage thickness (%) | Average shrinkage width (%) | Average shrinkage length (%) |
|---|---|---|---|---|
| 977 | Re/Mo (−200/−635) 1% Hf 2% HfC | 4.27 | 4.10 | 3.93 |
| 978 | Re/Mo (−200/−635) 1% Hf 2% HfC | 5.03 | 4.56 | 4.08 |

TABLE 13

CDC Processing/Properties of Variety of Re/Mo with Hf and HfC Alloy Green Ring Parts

| Sample #: | Description: | Mass: grams | ID (in): | OD (in): | Height (in): | Density (g/cc) |
|---|---|---|---|---|---|---|
| 1023 | Re/Mo(−200) | 5.202 | 0.3215 | 0.5030 | 0.2435 | 11.0920 |
| 1024 | Re/Mo(−200) Re/Mo(−635) 50% | 5.217 | 0.3215 | 0.5030 | 0.2445 | 11.0785 |
| 1025 | Re/Mo(−635) | 5.128 | 0.3215 | 0.5023 | 0.2330 | 11.4810 |
| 1026 | Re/Mo(−200/−635) 1% Hf 2% HfC | 5.216 | 0.3215 | 0.5030 | 0.2435 | 11.1219 |
| 1027 | Re/Mo(−200/−635) 5% Hf 2% HfC | 5.217 | 0.3215 | 0.5030 | 0.2420 | 11.1930 |
| 1028 | Re/Mo(−635) 1% Hf 2% HfC | 5.247 | 0.3215 | 0.5025 | 0.2390 | 11.4371 |
| 1029 | Re/Mo(−635) 5% Hf 2% HfC | 5.432 | 0.3215 | 0.5025 | 0.2485 | 11.3877 |
| 1030 | Re/Mo(−200) 1% Hf | 5.174 | 0.3215 | 0.5030 | 0.2445 | 10.9872 |

TABLE 14

Typical Surface Roughness Data of Sintered CDC Disk Samples

| Sample | Ra (μin) Average | Rrms (μin) RMS Roughness |
|---|---|---|
| Marked Side877 Mo-Re | 23 | 30 |

TABLE 14-continued

Typical Surface Roughness Data of Sintered CDC Disk Samples

| Sample | Ra (μin) Average | Rrms (μin) RMS Roughness |
|---|---|---|
| Unmarked Side 877 | 36 | 55 |
| Marked Side883 Re | 18 | 23 |
| Unmarked Side 883 | 36 | 44 |
| Marked Side887 Re | 16 | 22 |
| Unmarked Side 887 | 23 | 33 |
| Marked Side881 Mo-Re | 28 | 38 |
| Unmarked Side 881 | 24 | 31 |
| Marked Side897 Mo-Re-12.5 HfC | 44 | 59 |
| Unmarked Side 897 | 58 | 77 |
| Marked Side901 Re-1 Hf | 39 | 56 |
| Unmarked Side 901 | 40 | 62 |

TABLE 15

CDC Process Optimized Microstructural Grain Size

| Vacuum sintered 2300 deg C.; 4 hrs) | Top Side-avg (t) | Lower Side-avg (b) | t + b avg | stdev | avedev |
|---|---|---|---|---|---|
| ReMo | 120.75 | 103.25 | 112.00 | 31.29 | 24.8 |
| ReMo 1% Hf 2% HfC | 80.17 | 81.94 | 81.05 | 31.93 | 26.4 |
| ReMo 3% Hf 2% HfC | 65.44 | 103.96 | 84.70 | 32.82 | 25.0 |
| H2 sintered 2300 deg C.; 4 hrs) | | | | | |
| ReMo | 65.42 | 63.44 | 64.43 | 23.74 | 18.8 |
| ReMo 1% Hf 2% HfC | 68.38 | 59.69 | 64.03 | 37.54 | 30.6 |
| ReMo 3% Hf 2% HfC | 58.46 | 58.63 | 58.54 | 25.54 | 21.9 |

TABLE 16

Latest Results of the Near-Net Shape Liner Parts (Parts made of both Coarse and Fine Grained Alloys)

| Sample #: | Description: | Green Density (g/cc) | Percent of Theory: | Mass: (g) | ID (in) | OD (in) | Length (in) | Theoretical Density (g/cc) |
|---|---|---|---|---|---|---|---|---|
| 1432 | ReMo (−200) | 8.7076 | 64.41 | 352.0 | 0.4780 | 1.3580 | 1.9440 | 13.5195 |
| 1433 | ReMo (−200) | 10.4169 | 77.05 | 350.1 | 0.4770 | 1.3570 | 1.6180 | 13.5195 |
| 1434 | ReMo (−635) | 10.3674 | 76.69 | 350.4 | 0.4765 | 1.3565 | 1.6280 | 13.5195 |
| 1435 | ReMo (−635) | 11.1163 | 82.22 | 372.1 | 0.4765 | 1.3570 | 1.6110 | 13.5195 |

APPENDIX A

Table 17. Select Test matrix of all the Typical CDC process Conditions Used and Properties of Green Samples

| Sample #: | Description: | Peak Compaction pressure; tsi | Green Density (g/cc) | Percent of Theory: | Die Geometry: | ID (in): | OD (in): | Thickness (in): | Mass: (g) | Theoretical Density: (g/cc) | Width, middle, smallest | Width, end avg (in) | Length (in) |
|---|---|---|---|---|---|---|---|---|---|---|---|---|---|
| 876 | Re/Mo(−200) | 144.5 | 11.3512 | 81.11 | ½" Cylinder | | 0.5030 | 0.1090 | 4.029 | 13.9951 | | | |
| 877 | Re/Mo(−200) | 129.7 | 11.2082 | 80.09 | ½" Cylinder | | 0.5030 | 0.1105 | 4.033 | 13.9951 | | | |
| 878 | Re/Mo(−200) | 153.3 | 11.4478 | 81.80 | ½" Cylinder | | 0.5030 | 0.1080 | 4.026 | 13.9951 | | | |
| 879 | Re/Mo(−200) | 153.7 | 11.4620 | 81.90 | ½" Cylinder | | 0.5030 | 0.1080 | 4.031 | 13.9951 | | | |
| 880 | Re/Mo(−200) | 148.9 | 11.4364 | 81.72 | ½" Cylinder | | 0.5030 | 0.1080 | 4.022 | 13.9951 | | | |
| 881 | Re/Mo(−200) | 153.1 | 11.4791 | 82.02 | ½" Cylinder | | 0.5030 | 0.1080 | 4.037 | 13.9951 | | | |
| 882 | Re(−200) | 153.0 | 15.9155 | 75.72 | ½" Cylinder | | 0.5025 | 0.1062 | 5.493 | 21.0200 | | | |
| 883 | Re(−200) | 153.7 | 15.9600 | 75.93 | ½" Cylinder | | 0.5025 | 0.1060 | 5.498 | 21.0200 | | | |
| 884 | Re(−200) | 154.5 | 15.9571 | 75.91 | ½" Cylinder | | 0.5025 | 0.1060 | 5.497 | 21.0200 | | | |
| 885 | Re(−200) | 155.4 | 15.9484 | 75.87 | ½" Cylinder | | 0.5025 | 0.1060 | 5.494 | 21.0200 | | | |
| 886 | Re(−200) | 152.4 | 15.9213 | 75.74 | ½" Cylinder | | 0.5025 | 0.1062 | 5.495 | 21.0200 | | | |
| 887 | Re(−200) | 145.7 | 15.7764 | 75.05 | ½" Cylinder | | 0.5025 | 0.1070 | 5.486 | 21.0200 | | | |
| 889 | Re/Mo(−200) 50% HfC | 154.1 | | | ½" Cylinder | | | | | 13.2996 | | | |
| 890 | Re/Mo(−200) 25% HfC | 162.3 | 10.4856 | 76.88 | ½" Cylinder | | 0.5025 | 0.1170 | 3.987 | 13.6385 | | | |
| 891 | Re/Mo(−200) 12.5% HfC | 156.6 | | | ½" Cylinder | | | | | 13.8145 | | | |
| 892 | Re/Mo(−200) 50% HfC | 152.5 | 11.7221 | 88.14 | ½" Cylinder | | 0.5025 | 0.1050 | 4.000 | 13.2996 | | | |
| 893 | Re/Mo(−200) 25% HfC | 147.2 | 10.5552 | 77.39 | ½" Cylinder | | 0.5035 | 0.1160 | 3.995 | 13.6385 | | | |
| 894 | Re/Mo(−200) 12.5% HfC | 158.6 | 11.0058 | 79.67 | ½" Cylinder | | 0.5035 | 0.1110 | 3.986 | 13.8145 | | | |
| 895 | Re/Mo(−200) 12.5% HfC | 154.3 | 11.0311 | 79.85 | ½" Cylinder | | 0.5033 | 0.1110 | 3.992 | 13.8145 | | | |
| 896 | Re/Mo(−200) 12.5% HfC | 154.9 | 11.0300 | 79.84 | ½" Cylinder | | 0.5032 | 0.1100 | 3.990 | 13.8145 | | | |
| 897 | Re/Mo(−200) 12.5% HfC | 157.9 | 11.0650 | 80.10 | ½" Cylinder | | 0.5033 | 0.1103 | 3.979 | 13.8145 | | | |
| 898 | Re/Mo(−200) 12.5% HfC | 155.9 | 11.0194 | 79.77 | ½" Cylinder | | 0.5030 | 0.1110 | 3.983 | 13.8145 | | | |
| 899 | Re/Mo(−200) 12.5% HfC | 153.7 | 10.9807 | 79.49 | ½" Cylinder | | 0.5030 | 0.1110 | 3.969 | 13.8145 | | | |
| 900 | Re(−200) 1% Hf | 154.3 | 15.8051 | 75.63 | ½" Cylinder | | 0.5025 | 0.1070 | 5.496 | 20.8989 | | | |
| 901 | Re(−200) 1% Hf | 155.7 | 15.8396 | 75.79 | ½" Cylinder | | 0.5025 | 0.1070 | 5.508 | 20.8989 | | | |
| 902 | Re(−200) | 151.1 | 15.8109 | 75.22 | ½" Cylinder | | 0.5025 | 0.1070 | 5.498 | 21.0200 | | | |
| 903 | Re(−200) | 144.4 | 15.7431 | 74.90 | ½" Cylinder | | 0.5025 | 0.1075 | 5.500 | 21.0200 | | | |
| 904 | Re/Mo(−200) | 152.9 | 11.3878 | 81.37 | ½" Cylinder | | 0.5030 | 0.1090 | 4.042 | 13.9951 | | | |
| 905 | Re/Mo(−200) | 156.2 | 11.3935 | 81.41 | ½" Cylinder | | 0.5030 | 0.1090 | 4.044 | 13.9951 | | | |
| 906 | Re/Mo(−200) 1% Hf | 152.6 | 11.3354 | 81.04 | ½" Cylinder | | 0.5030 | 0.1088 | 4.016 | 13.9879 | | | |
| 907 | Re/Mo(−200) 1% Hf | 151.9 | 11.3060 | 80.83 | ½" Cylinder | | 0.5030 | 0.1093 | 4.024 | 13.9879 | | | |
| 908 | Re/Mo(−200) | 134.0 | 11.4738 | 81.98 | Tensile | | | 0.1380 | 25.947 | 13.9951 | | | |
| 909 | Re/Mo(−200) | 130.4 | 11.5246 | 82.35 | Tensile | | | 0.1428 | 26.959 | 13.9951 | 0.1290 | 0.1360 | 3.5420 |
| 910 | Re(−200) | 133.1 | 15.9438 | 75.85 | Tensile | | | 0.1452 | 37.928 | 21.0200 | 0.1300 | 0.1450 | 3.5400 |
| 911 | Re(−200) | 130.3 | 15.8535 | 75.42 | Tensile | | | 0.1462 | 37.973 | 21.0200 | 0.1290 | 0.3450 | 3.5400 |
| 912 | Re/Mo(−200) 1% Hf | 127.8 | 11.7157 | 83.76 | Tensile | | | 0.1405 | 26.974 | 13.9879 | 0.1300 | 0.3458 | 3.5430 |
| 913 | Re/Mo(−200) 1% Hf | 132.3 | 11.5023 | 82.23 | Tensile | | | 0.1430 | 26.954 | 13.9879 | 0.1300 | 0.3460 | 3.5420 |
| 914 | Re(−200) 1% Hf | 136.5 | 15.9798 | 76.46 | Tensile | | | 0.1450 | 37.970 | 20.8989 | 0.1300 | 0.3450 | 3.5400 |
| 915 | Re(−200) 1% Hf | 136.0 | 15.9668 | 76.40 | Tensile | | | 0.1451 | 37.961 | 20.8989 | 0.1300 | 0.3450 | 3.5400 |

APPENDIX A-continued

Table 17. Select Test matrix of all the Typical CDC process Conditions Used and Properties of Green Samples

| Sample #: | Description: | Peak Compaction pressure; tsi | Green Density (g/cc) | Percent of Theory: | Die Geometry: | ID (in): | OD (in): | Thickness (in): | Mass: (g) | Theoretical Density: (g/cc) | Width, middle, smallest | Width, end avg (in) | Length (in) |
|---|---|---|---|---|---|---|---|---|---|---|---|---|---|
| 916 | Re/Mo(−200) 12.5% HfC | 136.7 | 11.0800 | 80.21 | Tensile | | | 0.1485 | 26.963 | 13.8145 | 0.1300 | 0.3460 | 3.4600 |
| 917 | Re/Mo(−200) 12.5% HfC | 135.5 | 11.1986 | 81.06 | Tensile | | | 0.1469 | 26.961 | 13.8145 | 0.1300 | 0.2960 | 3.5450 |
| 918 | Re/Mo(−200) 12.5% HfC | 135.7 | 10.7985 | 78.17 | Tensile | | | 0.1524 | 26.971 | 13.8145 | 0.1300 | 0.3460 | |
| 944 | Re/Mo(−200) 5% Hf | 135.5 | 11.6942 | 83.77 | Tensile | | | 0.1407 | 26.963 | 13.9592 | 0.1295 | 0.3460 | 3.4530 |
| 945 | Re(−200) 5% Hf | 132.0 | 15.6750 | 76.73 | Tensile | | | 0.1478 | 37.965 | 20.4283 | 0.2295 | 0.3450 | 3.5405 |
| 946 | Re/Mo(−200) 1% Hf 2% HfC | 131.6 | 11.3190 | 81.09 | Tensile | | | 0.1453 | 26.951 | 13.9387 | 0.2295 | 0.3460 | 3.5435 |
| 947 | Re(−200) 1% Hf 2% HfC | 130.7 | 15.6324 | 75.78 | Tensile | | | 0.1483 | 37.990 | 20.6286 | 0.2300 | 0.3450 | 3.5415 |
| 948 | Re/Mo(−200) Re/Mo(−635) 50% | 136.6 | 11.7130 | 83.69 | Tensile | | | 0.1406 | 26.987 | 13.9951 | 0.2295 | 0.3455 | 3.5400 |
| 949 | Re/Mo(−200) 5% Hf 2% HfC | 138.7 | 11.4818 | 82.42 | Tensile | | | 0.1365 | 25.683 | 13.9301 | 0.2295 | 0.3460 | 3.5430 |
| 953 | Re/Mo(−635) | 129.5 | 11.0009 | 78.61 | Ring | 0.3220 | 0.5030 | 0.2530 | 5.349 | 13.9951 | | | |
| 954 | Re/Mo(−200) Re/Mo(−635) 50% | 136.6 | 11.1260 | 79.50 | Ring | 0.3220 | 0.5025 | 0.2510 | 5.349 | 13.9951 | | | |
| 958 | Re/Mo(−635) 5% Hf | 138.9 | 11.8420 | 85.44 | Tensile | | | 0.1387 | 26.909 | 13.8592 | 0.2290 | 0.3430 | 3.5380 |
| 959 | Re(−635) 5% Hf | 136.8 | 15.7184 | 76.94 | Tensile | | | 0.1473 | 37.950 | 20.4283 | 0.2295 | 0.3453 | 3.5410 |
| 960 | Re/Mo(−635) 1% Hf 2% HfC | 132.6 | 11.7326 | 84.05 | Tensile | | | 0.1402 | 26.949 | 13.9587 | 0.2295 | 0.3450 | 3.5380 |
| 961 | Re(−635) 1% Hf 2% HfC | 138.7 | 15.6126 | 75.68 | Tensile | | | 0.1485 | 37.993 | 20.6286 | 0.2295 | 0.3473 | 3.5415 |
| 962 | Re/Mo(−635) 5% Hf 2% HfC | 133.0 | 11.7204 | 84.14 | Tensile | | | 0.1403 | 26.937 | 13.9304 | 0.2295 | 0.3450 | 3.5380 |
| 963 | Re/Mo(−635) | 134.3 | 11.7691 | 84.09 | Tensile | | | 0.1400 | 27.001 | 13.9951 | 0.2290 | 0.3450 | 3.5370 |
| 964 | Re(−635) | 132.6 | 15.8405 | 75.36 | Tensile | | | 0.1462 | 37.942 | 21.0200 | 0.2295 | 0.3450 | 3.5415 |
| 969 | Re/Mo(−200) | 136.7 | 11.4867 | 82.08 | Tensile | | | 0.1431 | 26.933 | 13.9951 | 0.2300 | 0.3460 | 3.5430 |
| 970 | Re/Mo(−200) | 134.9 | 11.4384 | 81.73 | Tensile | | | 0.1439 | 26.976 | 13.9951 | 0.2300 | 0.3456 | 3.5435 |
| 971 | Re/Mo(−200) 1% Hf | 132.4 | 11.4352 | 81.75 | Tensile | | | 0.1438 | 26.953 | 13.9879 | 0.2300 | 0.3455 | 3.5430 |
| 972 | Re/Mo(−200) 1% Hf | 147.1 | 11.5482 | 82.56 | Tensile | | | 0.1425 | 26.967 | 13.9879 | 0.2295 | 0.3460 | 3.5430 |
| 973 | Re/Mo(−200) 1% Hf 2% HfC | 137.0 | 11.3852 | 81.56 | Tensile | | | 0.1446 | 26.975 | 13.9587 | 0.2300 | 0.3460 | 3.5430 |
| 974 | Re/Mo(−200) 1% Hf 2% HfC | 129.8 | 11.4088 | 81.73 | Tensile | | | 0.1442 | 26.953 | 13.9587 | 0.2300 | 0.3460 | 3.5445 |
| 975 | Re(−200) | 130.1 | 15.8182 | 75.25 | Tensile | | | 0.1465 | 37.975 | 21.0200 | 0.2300 | 0.3450 | 3.5415 |
| 976 | Re(−200) | 130.2 | 16.2624 | 77.37 | Tensile | | | 0.1463 | 38.997 | 21.0200 | 0.2295 | 0.3455 | 3.5415 |
| 977 | Re/Mo(−200/ −635) 1% Hf 2% HfC | 146.6 | 11.6797 | 83.67 | Tensile | | | 0.1407 | 26.923 | 13.9587 | 0.2300 | 0.3460 | 3.5410 |
| 978 | Re/Mo(−200/ −635) 1% Hf 2% HfC | 135.2 | 11.5457 | 82.71 | Tensile | | | 0.1425 | 26.961 | 13.9587 | 0.2300 | 0.3455 | 3.5410 |
| 979 | Re/Mo(−635) 1% Hf | 135.6 | 11.7996 | 84.31 | Tensile | | | 0.1395 | 26.974 | 13.9951 | 0.2295 | 0.3450 | 3.5375 |
| 980 | Re/Mo(−635) 1% Hf | 135.4 | 11.8425 | 84.66 | Tensile | | | 0.1390 | 26.975 | 13.9879 | 0.2295 | 0.3450 | 3.5370 |
| 981 | Re/Mo(−635) 1% Hf 2% HfC | 134.5 | 11.7131 | 83.91 | Tensile | | | 0.1407 | 27.000 | 13.9587 | 0.2295 | 0.3458 | 3.5375 |
| 982 | Re(−635) 1% Hf 2% HfC | 146.6 | 15.7705 | 76.45 | Tensile | | | 0.1469 | 37.968 | 20.6286 | 0.2295 | 0.3455 | 3.5410 |
| 987 | Re(−635) | 142.1 | 15.9971 | 76.10 | Tensile | | | 0.1446 | 37.902 | 21.0200 | 0.2295 | 0.3450 | 3.5415 |
| 1013 | Re/Mo(−200) | | 11.3980 | 81.44 | 1" Cylinder | | 1.0055 | 0.2487 | 36.886 | 13.9951 | | | |
| 1014 | Re/Mo(−635) | | 11.6860 | 83.50 | 1" Cylinder | | 1.0040 | 0.2435 | 36.917 | 13.9951 | | | |
| 1023 | Re/Mo(−200) | | 11.0920 | 79.26 | Ring | 0.3215 | 0.5030 | 0.2435 | 5.202 | 13.9951 | | | |
| 1024 | Re/Mo(−200) Re/Mo(−635) 50% | | 11.0785 | 79.16 | Ring | 0.3215 | 0.5030 | 0.2445 | 5.217 | 13.9951 | | | |
| 1025 | Re/Mo(−635) | | 11.4810 | 82.04 | Ring | 0.3215 | 0.5023 | 0.2330 | 5.128 | 13.9951 | | | |
| 1026 | Re/Mo(−200/ −635) 1% Hf 2% HfC | | 11.1219 | 79.68 | Ring | 0.3215 | 0.5030 | 0.2435 | 5.216 | 13.9587 | | | |

APPENDIX A-continued

Table 17. Select Test matrix of all the Typical CDC process Conditions Used and Properties of Green Samples

| Sample #: | Description: | Peak Compaction pressure; tsi | Green Density (g/cc) | Percent of Theory: | Die Geometry: | ID (in): | OD (in): | Thickness (in): | Mass: (g) | Theoretical Density: (g/cc) | Width, middle, smallest | Width, end avg (in) | Length (in) |
|---|---|---|---|---|---|---|---|---|---|---|---|---|---|
| 1027 | Re/Mo(−200/−635) 5% Hf 2% HfC | | 11.1930 | 80.35 | Ring | 0.3215 | 0.5030 | 0.2420 | 5.217 | 13.9301 | | | |
| 1028 | Re/Mo(−635) 1% Hf 2% HfC | | 11.4371 | 81.93 | Ring | 0.3215 | 0.5025 | 0.2390 | 5.247 | 13.9587 | | | |
| 1029 | Re/Mo(−635) 5% Hf 2% HfC | | 11.3877 | 81.75 | Ring | 0.3215 | 0.5025 | 0.2485 | 5.432 | 13.9301 | | | |
| 1030 | Re/Mo(−200) 1% Hf | | 10.9872 | 78.55 | Ring | 0.3215 | 0.5030 | 0.2445 | 5.174 | 13.9879 | | | |

APPENDIX B

Table 18. Room Temperature Mechanical Properties of Select CDC Compacted and Hydrogen Sintered (2100 deg C.; 14 hrs) Mo—Re Composite Materials

| Sample ID | Thickness (inches) | Width (inches) | Ultimate Tensile Strength (ksi) | Yield Strength (ksi) | Elongation (%) | Elastic Modulus (×106 psi) |
|---|---|---|---|---|---|---|
| 945 (Re/5 Hf) | 0.1379 | 0.2108 | 103 | 71.5 | 2.8 | 70.6 |
| 946 (Re/Mo/1 Hf/2 HfC) | 0.1326 | 0.2220 | 114 | 50 | 22 | 66.7 |
| 948 (Re/Mo-50% −200 and 50% −635) | 0.1365 | 0.2220 | 130 | 110 | 6.4 | 57.1 |
| 949 (Re/Mo/5 Hf/2 HfC) | 0.1316 | 0.2234 | 98.5 | 98.5 | 0.7 | 60 |

TABLE 19

Sintered CDC Compacted (at 150 tsi) and Optimally Sintered Mechanical Test Samples Physical, Geometrical and Dimensional Shrinkage Characteristics

| Sample #: | Description: | Sintered Density (g/cc) | % TD | Mass: (g) | Thickness (in) | Width (in) | Length (in) | TD (g/cc) | % Change Thickness from Green | % Change Width from Die | % Change Length from Die |
|---|---|---|---|---|---|---|---|---|---|---|---|
| 1538 | ReMo41 (−635) | 12.7135 | 98.19 | 25.6818 | 0.1334 | 0.3318 | 3.3925 | 12.9475 | −4.47 | −3.28 | −3.87 |
| 1539 | Re (−635) | 20.5654 | 97.84 | 36.5741 | 0.1303 | 0.3155 | 3.2140 | 21.0200 | −7.57 | −8.02 | −8.93 |
| 1540 | Rc (−325) | 20.1022 | 95.63 | 34.1383 | 0.1296 | 0.3085 | 3.1510 | 21.0200 | −8.42 | −10.06 | −10.71 |
| 1541 | Re (−325)* | 19.8208 | 94.29 | 39.0335 | 0.1315 | 0.3295 | 3.3750 | 21.0200 | −6.41 | −3.94 | −4.36 |
| 1542 | WRe25 | 19.0637 | 96.76 | 35.2450 | 0.1311 | 0.3240 | 3.2825 | 19.7031 | −6.87 | −5.54 | −6.98 |
| 1543 | ReMo41(−635) 10% W | 12.9462 | 96.70 | 26.2763 | 0.1302 | 0.3330 | 3.4140 | 13.3882 | −7.46 | −2.92 | −3.26 |
| 1544 | ReMo41(−635) 10% Ta | 12.5364 | 94.69 | 26.3284 | 0.1362 | 0.3365 | 3.4330 | 13.2388 | −2.80 | −1.90 | −2.72 |
| 1545 | ReMo41(−635) 0.5% Hf 2% HfC | 12.5373 | 96.86 | 25.4473 | 0.1348 | 0.3325 | 3.3935 | 12.9436 | −4.48 | −3.06 | −3.84 |
| 1546 | Re(−635) 0.5% Hf 2% HfC | 20.2618 | 97.94 | 36.0393 | 0.1303 | 0.3145 | 3.2215 | 20.6874 | −7.94 | −8.31 | −8.71 |
| 1547 | Re(−635) 5% Mo 0.5% Hf 2% HfC | 19.1473 | 97.37 | 34.2450 | 0.1291 | 0.3170 | 3.2355 | 19.6648 | −7.52 | −7.58 | −8.32 |
| 1548 | Re(−635) 5% Ta 0.5% Hf 2% HfC | 19.5268 | 95.63 | 35.9221 | 0.1313 | 0.3210 | 3.2780 | 20.4199 | −7.89 | −6.41 | −7.11 |

TABLE 19-continued

Sintered CDC Compacted (at 150 tsi) and Optimally Sintered Mechanical Test Samples
Physical, Geometrical and Dimensional Shrinkage Characteristics

| Sample #: | Description: | Sintered Density (g/cc) | % TD | Mass: (g) | Thickness (in) | Width (in) | Length (in) | TD (g/cc) | % Change Thickness from Green | % Change Width from Die | % Change Length from Die |
|---|---|---|---|---|---|---|---|---|---|---|---|
| 1549 | WRe25 | 18.9388 | 96.12 | 35.5827 | 0.1319 | 0.3240 | 3.3015 | 19.7031 | −7.10 | −5.54 | −6.45 |
| 1550 | WRe25 0.5% Hf 2% HfC | 19.0259 | 97.87 | 35.1768 | 0.1310 | 0.3215 | 3.2885 | 19.4406 | −7.85 | −6.27 | −6.81 |
| 1551 | WRe25 5% Mo 0.5% Hf 2% HfC | 17.7901 | 95.70 | 33.6007 | 0.1325 | 0.3260 | 3.3185 | 18.5896 | −5.58 | −4.96 | −5.96 |
| 1552 | WRe25 5% Ta 0.5% Hf 2% HfC | 18.1775 | 94.37 | 34.8838 | 0.1310 | 0.3290 | | 19.2629 | −6.37 | −4.08 | |

TABLE 22

High Temperature Mechanical Properties of additional Refractory materials and their composites at 3500 deg F.
Table 1 Tensile Data for Combustion Driven Compacted Re, Mo—Re and W—Re Alloys supplied by UTRON, Inc

| Material Description | Specimen Number | Specimen Density ($g/cm^3$) | Nominal Gage Section (in) | Test Temp ° F. | Elastic Modulus (Msi) | Maximum Stress (psi) | 0.2% Offset Yield (psi) | Strain at Max Stress (in/in) | Fracture Location (gage, top or bottom) |
|---|---|---|---|---|---|---|---|---|---|
| Mo—41% Re (−635) | TN-1538 | 12.6820 | 0.080 × 0.100 × 1.00 GL | 3500 | 8.57 | 5300 | 3500 | 0.0401 | middle of gage section |
| Re (−635) | TN-1539 | 20.7154 | 0.080 × 0.100 × 1.00 GL | 3500 | 13.40 | 16700 | 8100 | 0.0360 | middle of gage section |
| Re (−325) | TN-1540 | 20.1019 | 0.080 × 0.100 × 1.00 GL | 3500 | 8.20 | 18500 | 10400 | 0.0341 | middle of gage section |
| Re (−325-Ultramet) | TN-1541 | 19.9024 | 0.080 × 0.100 × 1.00 GL | 3500 | 6.27 | 17600 | 7500 | 0.0346 | away from tab runout, top |
| W—25% Re | TN-1549 | 18.9648 | 0.080 × 0.100 × 1.00 GL | 3500 | 18.32 | 17100 | 10900 | 0.0462 | middle of gage section |
| Mo—41% Re (−635) 10% W | TN-1543 | 12.9494 | 0.080 × 0.100 × 1.00 GL | 3500 | 18.09 | 6300 | 3800 | 0.0278 | middle of gage section |
| Mo—41% Re (−635) 10% Ta | TN-1544 | 12.6020 | 0.080 × 0.100 × 1.00 GL | 3500 | 11.49 | 8800 | 6200 | 0.0298 | away from tab runout, bottom |
| Mo—41% Re (−635) 0.5% Hf—2% HfC | TN-1545 | 12.5622 | 0.080 × 0.100 × 1.00 GL | 3500 | 17.14 | 8800 | 5700 | 0.0285 | middle of gage section |
| Re (−635) 0.5% Hf—2% HfC | TN-1546 | 20.2950 | 0.080 × 0.100 × 1.00 GL | 3500 | 19.18 | 27100 | 14700 | 0.0192 | near tab runout, bottom |
| Re (−635) 5% Mo—0.5% Hf—2% HfC | TN-1547 | 19.3148 | 0.080 × 0.100 × 1.00 GL | 3500 | 18.13 | 30100 | 17000 | 0.0187 | middle of gage section |
| Re (−635) 5% Ta—0.5% Hf—2% HfC | TN-1548 | 19.8185 | 0.080 × 0.100 × 1.00 GL | 3500 | 25.15 | 37200 | 18400 | 0.0214 | middle of gage section |
| W—25% Re—0.5% Hf—2% HfC | TN-1550 | 19.1845 | 0.080 × 0.100 × 1.00 GL | 3500 | 19.68 | 29400 | 18000 | 0.0532 | middle of gage section |

Notes:

1. Tensile specimen density measurements were taken using the immersion density method in alcohol. The density value for Tn-1541 was taken post-test, while the other specimen densities were measured pre-test.
2. "Top" and "Bottom" under Fracture Location refers to the position of the break relative to the load train.
3. The specimens were tested at a stress rate of 30 ksi/min; however, specimen TN-1545 was tested at a rate of 22 ksi/min in error.

We claim:

1. A process of producing refractory near net shape rhenium composite components with a combustion driven compaction process, comprising:

providing a chamber, providing a cavity, providing rhenium containing powder and hafnium powder, wherein the rhenium containing powder have a mesh size between −200 and −635, providing a male die adjacent the cavity, providing a piston in contact with the male die, providing a gas supply, filling the chamber with a mixture of compressed natural gas and air, moving the piston and moving the male die into the cavity, and closing the gas supply, combusting the gas, causing the pressure in the chamber to rise and exert force on the piston, compressing the powder mixture into a refractory near net shape rhenium containing component, wherein the refractory near net shape rhenium composite component contains less than 50 wt % rhenium and 1-5 wt % hafnium.

2. The process of claim 1, further comprising providing refractory materials powder containing Re with a particle size determined by a desired shrinkage of the compressed powder.

3. A refractory material comprising a Mo—Re, W—Re or Re made by the combustion driven compaction process of claim 1, wherein the refractory material are formed of rhenium containing powder having a mesh size between −200 and −635 and hafnium powder and exhibits a green density of 75-82% of theoretical density, and the refractory materials comprise less than 50 wt. % rhenium and 1-5 wt % hafnium.

4. The refractory material of claim 3, wherein the refractory material has an average grain size of less than 64 microns.

5. The refractory materials of claim 3, comprising Re and a material selected from the group consisting of HfC, TaC, SiC, Mo, Nb, $HfB_2$, $B_4C$, carbon borides, and carbon silicides.

6. The refractory material of claim 5, further comprising HfC.

7. The refractory material of claim 3, wherein the material has less shrinkage during sintering compared to materials made by powder metallurgy using compaction pressure less than about 55 tsi.

8. The product of claim 3, further comprising 2-12.5 wt. % HfC.

9. A product comprising a compacted near-net-shape part of refractory material made by the combustion driven compaction process of claim 1, wherein the compacted near-net-shape part is formed of Mo—Re powder or W—Re powder having a mesh size between −200 and −635 and hafnium powder and exhibits a green density of 75-82% of theoretical density and a strength of about 40,000 psi or more at 2500° F., and the compacted near-net-shape part comprises less than 50 wt. % rhenium and 1-5 wt % hafnium.

10. The product of claim 9, wherein the Mo—Re powder has a composition of 59Mo-41 Re by weight percent.

11. The product of claim 9, wherein the W—Re powder has a composition of 75W-25Re by weight percent.

12. The product of claim 9, further comprising 2-12.5 wt. % HfC.

13. The product of claim 9, wherein the compacted near-net-shape part further comprises a material selected from the group consisting of HfC, TaC, SiC, Nb, HfB2, B4C, carbon borides, and carbon silicides.

14. The process of claim 1, further comprising 2-12.5 wt. % HfC.

15. A process of producing refractory near net shape rhenium composite components with a combustion driven compaction process, comprising:

providing a chamber, providing a cavity, providing rhenium containing powder and HfC powder, wherein the rhenium containing powder have a mesh size between −200 and −635, providing a male die adjacent the cavity, providing a piston in contact with the male die, providing a gas supply, filling the chamber with a mixture of compressed natural gas and air, moving the piston and moving the male die into the cavity, and closing the gas supply, combusting the gas, causing the pressure in the chamber to rise and exert force on the piston, compressing the powder mixture into a refractory near net shape rhenium containing component, wherein the refractory near net shape rhenium composite component contains less than 50 wt % rhenium and 2-12.5 wt % HfC.

16. A product comprising a compacted near-net-shape part of refractory material made by the combustion driven compaction process of claim 15, wherein the compacted near-net-shape part is formed of Mo—Re powder or W—Re powder having a mesh size between −200 and −635 and HfC powder and exhibits a green density of 75-82% of theoretical density and a strength of about 40,000 psi or more at 2500° F., and the compacted near-net-shape part comprises less than 50 wt. % rhenium and 2-12.5 wt % HfC.

17. The product of claim 16, wherein the Mo—Re powder has a composition of 59Mo-41Re by weight percent.

18. The product of claim 16, wherein the W—Re powder has a composition of 75W-25Re by weight percent.

19. The product of claim 16, wherein the compacted near-net-shape part further comprises a material selected from the group consisting of TaC, SiC, Nb, HfB2, B4C, carbon borides, and carbon silicides.

20. The process of claim 15, further comprising about 1 wt. % to about 5 wt. % Hf.

21. A refractory material comprising a Mo—Re, W—Re or Re made by the combustion driven compaction process of claim 15, wherein the refractory material are formed of rhenium containing powder having a mesh size between −200 and −635 and HfC powder and exhibits a green density of 75-82% of theoretical density, and the refractory materials comprise less than 50 wt. % rhenium and 2-12.5 wt % HfC.

22. The refractory material of claim 21, wherein the material has an average grain size of less than 64 microns.

23. The refractory material of claim 21, comprising Re and a material selected from the group consisting of Mo/Re, Hf, W Re, TaC, SiC, Mo, Nb, $HfB_2$, $B_4C$, carbon borides, and carbon silicides.

24. The refractory material of claim 21, wherein the material has less shrinkage during sintering compared to materials made by powder metallurgy using compaction pressure less than about 55 tsi.

25. The process of claim 15, further comprising providing refractory materials powder containing Re with a particle size determined by a desired shrinkage of the compressed powder.

* * * * *